United States Patent [19]

Ikenque et al.

[11] 4,039,334

[45] Aug. 2, 1977

[54] THERMALLY DEVELOPABLE LIGHT-SENSITIVE MATERIAL

[75] Inventors: Shinpei Ikenque; Takao Masuda; Yuzo Iwata, all of Asaka, Japan

[73] Assignee: Fuji Photo Film Co., Ltd., Minami-ashigara, Japan

[21] Appl. No.: 632,885

[22] Filed: Nov. 17, 1975

[30] Foreign Application Priority Data

Nov. 15, 1974 Japan ..... 49-131827

[51] Int. Cl.[2] ..... G03C 1/02

[52] U.S. Cl. ..... 96/114.1

[58] Field of Search ..... 96/114.1, 67

[56] References Cited

U.S. PATENT DOCUMENTS

| | | | |
|---|---|---|---|
| 3,107,174 | 10/1963 | Wartman | 96/114. 1 |
| 3,600,170 | 8/1971 | Levy | 96/114.1 |
| 3,645,739 | 2/1972 | Ohkubo et al. | 96/114.1 |
| 3,748,134 | 7/1973 | Jones et al. | 96/114.1 |
| 3,756,829 | 9/1973 | Ohkubo et al. | 96/114.1 |
| 3,816,132 | 6/1974 | Takegawa et al. | 96/114.1 |

*Primary Examiner*—Mary F. Kelley

*Attorney, Agent, or Firm*—Sughrue, Rothwell, Mion, Zinn and Macpeak

[57] ABSTRACT

In a thermally developable light-sensitive material comprising a support having therein or thereon at least one layer containing at least (a) an organic silver salt, (b) a light-sensitive silver halide or a component capable of forming a light-sensitive silver halide and (c) a reducing agent, the improvement wherein at least one layer provided on the support comprises, or the support is impregnated with, (d) at least one member selected from the group consisting of rosin of an acid value more than about 100, one or more diterpene acids or a mixture thereof in an amount sufficient to decrease heat fogging and to improve the storability of light-sensitive materials.

15 Claims, No Drawings

THERMALLY DEVELOPABLE LIGHT-SENSITIVE MATERIAL

BACKGROUND OF THE INVENTION

1. Field of the Invention

This invention relates to a thermally developable light-sensitive material, more particularly, to a thermally developable light-sensitive material which shows decreased thermal fog (undesirable fog caused in unexposed portions upon heating) as compared to an identical element lacking rosin or a diterpene acid by incorporating therein at least one rosin or diterpene acid.

Another aspect of the invention relates to a thermally developable light-sensitive material which shows decreased thermal fog and an improvement in "green" shelf stability (the capability of retaining, even after storage, the photographic characteristics of the light-sensitive material immediately after production, especially sensitivity), particularly at high humidity, by incorporating therein rosin and/or a diterpene acid, and optionally sulfinic acid and/or a salt thereof.

2. Description of the Prior Art

The most widely used photographic process is a process in which silver halides are employed since such a photographic process provides an element with superior photographic properties, such as sensitivity and gradation, as compared to elements resulting from other photographic processes such as an electro-photographic process or a diazo process. There are, however, disadvantages in the silver halide photographic process. For example, the silver halide light-sensitive element must be developed in an aqueous developing solution after exposure and the thus developed light-sensitive element must be further subjected to several aqueous solution processings such as stopping, fixing and stabilization, in order to prevent the thus formed image from discoloring or fading and to prevent the undeveloped white areas in the image (background) from darkening. These solution processings are time-consuming and troublesome, and the chemicals employed in these processings are hazardous to handle, stain the worker's body and clothes and the processing room, and further can give rise to environmental pollution if the solutions are discharged without treatment into a stream or the like.

Therefore, a light-sensitive element which utilizes high speed silver halides which can be dry processed without using processingg solutions and which is, moreover, capable of forming a stable image with minimal background discoloration under normal room illumination has been desired.

To achieve such, various efforts have been made. For example, German Pat. Nos. 1,123,203 and 1,174,157 disclose that heat development of a sliver halide light-sensitive element is possible by incorporating therein a 3-pyrazolidone type developing agent. German Pat. No. 1,175,075 disclosed that the heat-developability of such an element can be promoted by incorporating therein a material capable off forming water, and German Pat. No. 1,003,578 discloses the additional incorporation therein of a fixing agent for the silver halide. According to the above-described techniques, however, the silver halide remaining in the element after the dry processing is never completely stabilized against light, that is, the former three patents do not describe a dry fixing step and in the light-sensitive element described in the last patent it can be easily appreciated that the co-presence of a developing agent (a reductant) and a fixing agent during storage gives rise to an undesirable reaction, which makes the element in practical for use as has been experimentally confirmed.

At present, the most successful light-sensitive element capable of forming a photographic image by dry processing is a heat developable light-sensitive element employing a composition comprising a silver salt of an organic acid, a small amount of a light-sensitive silver halide and a reducing agent, e.g., as described in U.S. Pat. Nos. 3,152,904 and 3,457,075. In this light-sensitive system, the silver halide which remains in the element after development is not stabilized against light and is allowed to be discolored by light. Nevertheless, the element provides results as if it were stabilized, because the silver halide is only used in a slight amount and most of the silver source is a white or light-colored organic silver salt which is stable and hardly blackened by light. Thus, even if a small amount of silver halide is discolored by light, the slight discoloring does not give rise to any visual difficulties since the element, on the whole, still appears white or only slightly colored. The light-sensitive element is stable at normal temperature, but when it is image-wise exposed and heated to a temperature, usually above about 80° C, preferably above 100° C, the organic silver salt oxidizing agent and the reducing agent which are present in the light-sensitive element undergo an oxidation-reduction reaction due to the catalytic action of the exposed silver halide present in the vicinity thereof to form silver. By this reaction, the exposed areas of the light-sensitive layer are rapidly blackened so that contrast is formed between the exposed areas and thheunexposed areas (background), that is, an image is formed.

This invention is concerned with an improvement in the afore-said thermally developable light-sensitive materials, particularly, it has as its object reducing thermal fog using a stabilizing agent.

Various methods have hitherto been known for preventing thermal fog of thermally developable light-sensitive materials. One method is to use a mercury compound as described in Japanese Patent Publication No. 11,113/72. However, mercury compounds are poisonous and they are undesirable in practice since the use of such involves some danger. Another method for preventing thermal fog is to use an N-halogeno compound, such as N-halogenosuccinimide and N-halogenoacetamide as described in Japanese Patent Applications (OPI) Nos. 10,724/74, 97,613/74 and 90,118/74. In addition, as one other method for preventing thermal fog, it is known to use an acid stabilizing agent, for example, higher aliphatic acids such as lauric acid, myristic acid, palmitic acid, stearic acid and behenic acid, salicylic acid, p-hydroxybenzoic acid, tetrabromobenzoic acid, tetrachlorobenzoic acid, p-acetamidobenzoic acid, alkyl-substituted benzoic acids such as p-t-butylbenzoic acid, phthalic acid, isophthalic acid, trimellitic acid, pyromellitic acid, diphenic acid, 5',5'-methylene bissalicylic acid, etc., as described in U.S. Pat. 3,645,739 and Japanese Pat. Application (OPI) No. 89,720/73.

The above N-halogeno compounds and the acid stabilizing agents have the effect of preventing thermal fog, but their effects are unsatisfactory for practical purposes.

Moreover, these compounds, in some cases, produce undesirable effects such as a lowering of sensitivity, a deterioration of light stability and a lowering of image density, which also inhibit the practical use of such compounds.

The inventors, after extensive investigation on the above problems of the prior art achieved this invention.

SUMMARY OF THE INVENTION

A first object of this invention is to provide a thermally developable light-sensitive material in which thermal background fog is substantially prohibited.

A second object of this invention is to provide a thermally developable light-sensitive material which is sensitized.

A third object of this invention is to provide a thermally developable light-sensitive material which has improved "green" shelf stability (especially sensitivity.). The green shelf stability can be evaluated by a forced ageing test. For example, it can be evaluated by changes in photographic characteristics of a light-sensitive material after standing at 50° for 24 hours.

This invention provides a thermally developable light-sensitive material comprising a support having therein or thereon at least one layer containing at least (a) an organic silver salt, (b) a light-sensitive silver halide or a component capable of forming a light-sensitive silver halide and (c) a reducing agent, in which (d) at least one material selected from the group consisting of rosin, one or more diterpene acid or a mixture thereof is incorporated in at least one layer provided in on the support or impregnated in the support.

For example, components (a), (b), (c) and (d) can be in the same layer, (a), (b) and (d) can be in the same layer, (a), (b) and (d) can be in the same layer and (c) in an adjacent layer, (a), (b), and (c) can be in the same layer and (d) in an adjacent layer, (a) and (b) can be in the same layer and (c) and (d) in an adjacent, and the like.

Of these, preferbly (a) and (b) are in the same layer, and it is particularly preferred that at least (a), (b) and (d) be in same layer.

Apart from the mechanism through which component (d) of this invention enables the achievement of the above objects, the fact that thermal fog is substantially prevented and sensitivity is increased was suprising to the inventors who have been active in this field for many years.

Other objects of this invention will be apparent from the following description and examples.

DETAILED DESCRIPTION OF THE INVENTION

Rosin is a natural substance resin mainly comprising resin acids which are generally obtained from crude turpentine or the roots of coniferous trees. In this invention, it is preferred to use rosin because of its low cost. The use of diterpene acids also permits the objects of this invention to be reached in quite the same manner as with rosin, although cost is increased.

The rosin used in the present invention are without limitation as to source and include natural rosins such as wood rosin, gum rosin, tall oil rosin, etc., and also rosin modified by hydrogenation, rosin esterified with a material such as a methyl or ethyl group, monoethylene glycol, diethlene gylcol, pentaerythritol, etc., and metal salts thereof (such as an alkali metal). Suitable rosins used in the present invention have an acid value more than about 100, most preferably from about 130 to about 200.

Specific examples of many diterpene acids are shown below:

Abietic acid, pimaric acid, neoabietic acid, levopimaric acid, iso-d-pimaric acid, podocarpic acid, agathenedicarboxylic acid, rubenic acid, dihydroabietic acid, tetrahydroabietic acid and dehydroabietic acid.

It is preferred to incorporate component (d) of this invention, i.e., the rosin, diterpene acid or mixture thereof, in a layer containing an organic silver salt (a) since the greatest effects can be obtained. Component (d) can be added at any time, but preferably is added before coating the lightsensitive layer on the support which contains organic silver salt (a) and after forming an organic silver salt (a). Component (d) is particularly preferably added after forming the organic silver salt(s) and light-sensitive silver halide(s) but before the addition of the reducing agent.

it is to be understood that component (d) can be impregnated into the support, if desired. In such a case, the range given below also applies. Where the support used is nonporous, the general rule, of course, is that the rosin and/or diterpene acid(s) will be used in layer form on the support.

Component (d) can be added as a solution or as a dispersion in an appropriate solvent or as a solid e.g., as a 0.5 to 50 wt % solution, preferably a 1 to 30 wt % solution. Addition as a solution is particularly preferred. The amount of component (d) added is preferably in the range of about 0.001 mol to about 10 mol, particularly about 0.01 to about 2 mol, per mole of organic silver salt (a) present. If too small an amount of component (d) is used, the effect is reduced. On the other hand, the addition of too great an amount of component (d) results in a lowering of Dmax and a lowering of the development rate.

Rosin which has been saponified with sodium hydroxide and the sodium or potassium salt of diterpene acids are unfavorable in this invention as they have no effect of preventing thermal fog.

We have also discovered that the photographic characteristics, such as thermal fog and shelf-life, of a thermally developable light-sensitive material of this invention can be further improved by using in combination with rosin, one or more diterpene acids or a mixture thereof, one or more sulfinic acids and/or salts thereof.

A preferred class of sulfinic acids and salts thereof can be represented by the following general formula:

$$R - SO_2M \qquad (I)$$

Wherein, R represents a monovalent aliphatic or aromatic group, and M is a positive monovalent ion, preferably an alkali metal.

Preferred sulfinic acids and salts thereof which are used in this invention are those of the above general formula (I) in which R is an alkyl group or a substituted alkyl group. Particularly preferred sulfinic acids are those of the above general formula (I) in which R is an aryl group or a substituted aryl group. M is particularly preferred to be an alkali metal ion or an ammonium ion, but it may represent an alkaline earth metal ion. Preferred examples of the above alkyl group are those having 6 to 22 carbon atoms such as hexyl, heptyl, ethylhexyl, octyl, nonyl, decyl, dodecyl, hexadecyl, octadecyl, eicosyl and docosyl. Preferred substituted alkyl groups include alkyl groups having 2 to 22 carbon atoms on the main chain thereof which have a substituent such as halogen atom (e.g., a chlorine, bromine, iodine), nitro group, alkoxy group (preferably, those having 1 to 8 carbon atoms such as methoxy, ethoxy, propoxy, butoxy, amyloxy, hexyloxy and octoxy), hydroxy group, cyano group, carboxy group, amino group and acetamido group. Preferred examples of the aryl group are a phenyl group and a naphthyl group. Substituted aryl groups include the above aryl groups having a substituent such as an alkyl group (particularly, those having 1 to 8 carbon atoms such as methyl, ethyl, propyl, butyl, hexyl and octyl), halogen atom (e.g., a chlorine, bromine, iodine atom, etc.), haloalkyl group (preferably, a haloalkyl group having 1 to 8 carbon atoms such as a chloromethyl, bromoethyl, bromopropyl, chlorobutyl, iodohexyl and chlorooctyl), nitro group, aryl group (e.g., phenyl, napthyl, etc.), alkylphenyl group (preferable with an alkyl moiety having 1 to 4 carbon atoms such as methyl, ethyl, propyl, butyl and t-butyl), hydroxy group, cyano group, carboxyl group, amino group or acetamido group.

Specific examples of the sulfinic acids and salts thereof which are used in this invention include n-octylsufinic acid, sodium n-octysulfinate, disodium 2-carboxyethylsulfinate, sodium 2-cyanoethylsulfinate, sodium 2-ethoxycarbonylethysulfinate, benzenesulfinic acid dihydrate, p-toluenesulfinic acid, sodium benzenesulfinate, sodium p-toluenesulfinate, potassium benzene-sulfinate, zinc p-toluenesulfinate, ammonium p-toluenesulfinate, 4-tert-butylbenzenesulfinic acid, p-bromobenzenesulfinic acid, p-chlorobenzenesulfinic acid, 4-acetamidobenzenesulfinic acid, sodium 3,4-dimethylbenzenesulfinate, potassium 3-methylbenzene-sulfinate, 4-nitrobenzenesulfinic acid and potassium 2-naphthylsulfinate. These compounds can be used as a mixture of two or more thereof. A suitable amount present in the element ranges from about 0.0001 mol to about 1 mol, preferably from 0.001 mol to 0.1 mol, per mol of organic silver salt.

The sulfinic acids or salts thereof can be effectively added at any time, i.e., during or after forming the organic silver salt, before or after forming the silver halide, or before or after adding additives such as a reducing agent and a color toning agent. However, it is preferred to add the sulfinic acids or salts thereof before coating the light-sensitive layer on a support but after forming the organic silver salt. The sulfinic acids or salts thereof can be added as a solution or dispersion, preferably as a solution.

U.S. Pat. No. 3,756,829 discloses that sodium benzene-sulfinate can be incorporated into a thermally developable light-sensitive material containing the silver salt of benzotriazole as an oxidizing agent for the silver salt, but the combination of this invention is different from the above and also differs in use, purpose and effect.

The organic silver salts employed as component (a) in the invention are colorless, white or slightly colored silver salts which are comparatively stable to light and which react with the reducing agent to form silver images when heated to a temperature of about 80° C or higher, preferably 100° C or higher, in the presence of exposed silver halide. Examples of organic silver salts include silver salts of organic compounds containing an imino group, a mercapto group, a thione group or a carboxyl group. Typical examples of these organic silver salts include:

1. Silver salts of organic compounds containing an imino group: Silver benzotriazole, silver nitrobenzotriazole, sler alkyl-substituted benzotriazoles (e.g., silver methylbenzotriazole), silver halogen-substituted benzotriazoles (e.g., silver bromobenzotriazole or silver chlorobenzotriazole), silver carboimide-substituted benzotriazoles (e.g.,

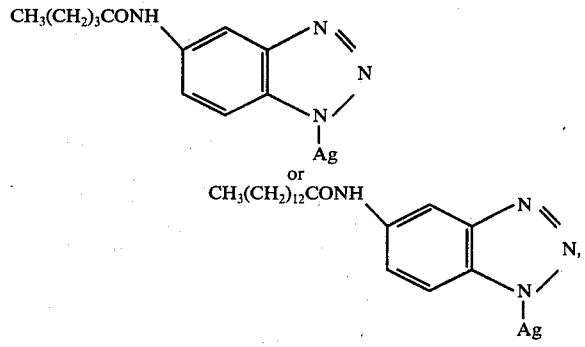

silver benzimidazole, silver substituted-benzimidazoles (e.g., silver 5-chlorobenzimidazole or silver 5-nitrobenzimidazole), silver carbozole, silver saccharin, silver phthalazinone, silver substituted-phthalazinone, silver salts of phthalimides, silver pyrrolidone, silver tetrazole and silver imidazole;

2. Silver salts of organic compounds containing a mercapto group or a thione group:

Silver 3-mercapto-4-phenyl-1,2,4-triazole, silver 2-mercaptobenzimidazole, silver 2-mercapto-5-aminothiadiazole, silver 1-phenyl-5-mercaptotetrazole, silver 2-mercaptobenzothiazole, silver salts of the thioglycolic acids as described in Japanese Patent Application (OPI) No. 28221/73 (e.g., silver 2-(S-ethylenethioglycolamido)benzthiazole or silver S-alkyl-($C_{12}$–$C_{22}$)thioglycolates), silver salts of dithiocarboxylic acids (e.g., silver dithioacetate), silver thioamide, silver salts of thiopyridines (e.g., silver 5-carbethoxy-1-methyl-2-phenyl-4-thiopyridine), silver dithiohydroxybenzole, silver mercaptotriazine, silver 2-mercaptobenzoxazole and silver mercaptooxadiazole, etc.;

3. Silver salts of organic compounds containing a carboxylic group:

a. Silver salts of aliphatic carboxylic acids:

Silver caprate, silver laurate, silver myristate, silver palmitate, silver stearate, silver behenate, silver maleate, silver fumarate, silver tartarate, silver furoate, silver linolate, silver oleate, silver hydroxystearate, silver adipate, silver sebacate, silver succinate, silver acetate, silver butyrate and silver camphorate;

b. Silver aromatic carboxylates:

Silver benzoate, silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, silver salts of other substituted benzoic acids, silver gallate, silver tannate, silver phthalate, silver terephthalate, silver salicylate, silver phenylacetate, silver pyromellitate, silver 4′-n-octadecyloxydiphenyl-4-carboxylate, silver thionecarboxylates as disclosed in U.S. Pat. No. 3,785,830 and silver salts of aliphatic carboxylic acids containing a thioether group as disclosed in U.S. Pat. No. 3,330,663;

4. Other silver salts:

Silver 4-hydroxy-6-methyl-1,3,3*a*,7-tetraazaindene, silver 5-methyl-7-hydroxy-1,2,3,4,6-pentaazindene, silver tetraazindene as disclosed in British Pat. No. 1,230,642, silver S-2-aminophenylthiosulfate as disclosed in U.S. Pat. No. 3,549,379, metal-containing aminoalcohols as disclosed in Japanese Patent Application (OPI) No. 6,586/71, and organic acid-metal chelates as disclosed in Belgian Pat. No. 768,411.

An oxidizing agent such as titanium dioxide zinc, oxide or gold carboxylates (e.g., aurous laurate, aurous stearate or aurous behenate) other than silver salts can be employed together with the organic silver salt, if desired.

Various processes are known for preparing such organic silver salts. One of the simplest processes for preparing them is described in U.S. Pat. No. 3,457,075 wherein a solution of an organic silver salt forming agent or a salt thereof in a water-miscible solvent, such as an alcohol or acetone, or in water is mixed with an aqueous solution of a water-soluble silver salt such as silver nitrate to prepare an organic silver salt.

Further, it is possible to use the process described in U.S. Pat. No. 3,839,049 wherein a colloidal dispersion of an ammonium salt or an alkali metal salt of an organic silver salt forming agent is mixed with an aqueous solution of a water-soluble silver salt such as silver nitrate. In a similar process, it is possible to use an aqueous solution of a silver complex salt such as a silver amine complex salt or a solution of such a salt in a water-miscible solvent instead of the aqueous solution of the water-soluble silver salt such as silver nitrate.

Another process for preparing organic silver salts is the process described in U.S. Pat. No. 3,458,544. Namely, in this process, organic carboxylic acid silver salts are prepared by mixing a substantially water immiscible solution (oily solution) such as a benzene solution of an organic carboxylic acid with an aqueous solution of a silver complex salt. Preferably the water is added to the oily solution to form an emulsion prior to mixing with the aqueous solution of the silver complex salt. This process can be also applied to the preparation of other organic silver salts.

A similar process has been described in Canadian Pat. No. 847,351 wherin the resulting organic silver salts are more stable to heat and light. In this process, a silver salt solution free of alkali, such as an aqueous solution containing only silver nitrate, is used instead of the silver complex salt.

Further, the process for preparing organic silver salts as described in British Pat. No. 1,405,867 can be used. This process is preferred because heat-developable light-sensitive materials containing the resulting organic silver salt do not form as much thermal fog. This process comprises mixing an emulsion composed of an aqueous solution of a salt (for example, an alkali metal such as a sodim salt, a potassium salt or a lithium salt or an ammonium salt, etc.) of water-soluble organic silver salt forming agent and an oil (for example, benzene, toluene, cyclohexane, pentane, hexane, carboxylic acid esters such as acetate, phosphoric acid esters, and oils such as castor oil, etc.) with a solution of, preferably an aqueous solution of, a silver salt which is more water-soluble than the organic silver salt (such as silver nitrate) or a silver complex salt to prepare the organic silver salt. In another embodiment of this process, it is possible to prepare the organic silver salt by mixing an aqueous alkali solution (for example, an aqueous solution of sodium hydroxide) with an oil-soluble solution of an organic silver salt forming agent (for example, a toluene solution of the organic silver salt forming agent) and mixing the resulting emulsion with a solution, preferably an aqueous solution, of a soluble silver salt such as silver nitrate or a silver complex salt such as a silver ammine complex salt.

The oils which can be used for the above-described process include the following compounds:

1. Phosphoric acid esters:
For example, tricresyl phosphate, tributyl phosphate, monooctyl dibutyl phosphate. etc.

2. Phthalic acid esters:
For example, diethyl phthalate, dibutyl phthalate, dimethyl phthalate, dioctyl phthalate, dimethoxyethyl phthalate, etc.;

3. Carboxylic acid esters:
For example, acetates such as amyl acetate, isopropyl acetate, isoamyl acetate, ethyl acetate, 2-ethylbutyl acetate, butyl acetate and propyl acetate, etc.; sebacates such as dioctyl sebacate, dibutyl sebacate, and diethyl sebacate, etc.; succinates such as diethyl succinate; formates such as ethyl formate, propyl formate, butyl formate and amyl formate, etc., tartarates such as diethyl tartarate; valerates such as ethyl valerate; butyrates such as methyl butyrate, ethyl butyrate, butyl butyrate and isoamyl butyrate; adipic acid esters, etc.;

4. Oils such as castor oil, cotton seed oil, linseed oil, tsubaki oil, etc.;

5. Aromatic hydrocarbons such as benzene, toluene xylene, etc.;

6. Aliphatic hydrocarbons such as pentane, hexane, heptane, etc.; and

7. Cyclic hydrocarbons such as cyclohexane.

Examples of the silver complex salts used include silver ammine complex salt, silver methylamine complex salt and silver ethylamine complex salt; preferably alkali-soluble complex salts having a dissociation constant higher than the organic silver salts are used.

Examples of solvents for the silver salts such as silver nitrate include not only water but also polar solvents such as dimethyl sulfoxide, dimethylformamide, acetonitrile, etc.

Further, ultrasonic waves can be employed during the preparation of the organic silver salts as described in West German Patent Application (OLS) No. 2,401,159. Particularly, emulsification can be easily carried out by applying ultrasonic waves when it is desired to emulsify water and oils. Further, it is possible to use surface active agents for the purpose of controlling the particle size of the organic silver salts during the preparation thereof.

The organic silver salts can also be prepared in the presence of polymers. A specific process therefore is described in U.S. Pat No. 3,700,458, which comprises mixing a non-aqueous solution of an organic carboxylic acid with a non-aqueous solution of a heavy metal salt of trifluoroacetate or tetrafluoroborate in the presence of a polymer to produce a heavy metal salt of the organic carboxylic acid, such as a silver salt thereof.

A process which comprises reacting a colloid dispersion of an organic silver salt forming agent with an aqueous solution of silver nitrate has been described in U.S. Pat. No. 3,839,049. Furthermore, a process for producing an emulsion using similar non-aqueous solutions has been described in U.S. Pat. No. 3,748,143. In addition, it is possible, as described in Japanese Pat. Application (OPI) No. 13,224/74 and West German Patent Application (OLS) No. 2,322,096, to change the particle form, the particle size and photographic properties such as light stability or sensitivity of the organic silver salts due to the presence of a metal salt or a metal complex such as a mercury or lead compound during the preparation of the organic silver salts. All such processes can be used.

It has also been confirmed that cobalt, manganese, nickel, iron, rhodium, iridium, platinum, gold, cadmium, zinc, lithium, copper, thallium, tin, bismuth, antimony, chromium, ruthernium, palladium and osmium, in addition to the mercury and lead described above, are effective as the metal in a metal salt or metal complex as described. In order to use these metal containing compounds, a mixture or dispersion of a solution of a silver salt forming organic compound and the metal containing compound can be mixed with an aqueous solution of a soluble silver salt such as silver nitrate or an aqueous solution of a silver complex salt such as a silver ammine complex salt. Further, a solution or dispersion of the metal containing compound can be mixed with an aqueous solution of the silver salt or a silver complex salt and a solution or dispersion of the silver salt forming organic compound. Furthermore, a method comprisng mixing a solution or dispersion of the silver salt forming organic compound with a solution or dispersion of a mixture of the silver salt or silver complex salt and the metal containing compound is also preferred. A preferred amount of the metal containing compound ranges from about $10^{-6}$ to $10^{-1}$ mols per mol of the organic silver salt and from about $10^{-5}$ to $10^{-2}$ mols per mol of the silver halide The particle size of the resulting organic silver salts is about 0.01 micron to about 10 microns as the longer diameter, preferably about 0.1 micron to about 5 microns.

Examples of light-sensitive silver halides which can be employed as component (b) in the invention include silver chloride, silver bromide, silver iodide, silver chlorobromoiodide, silver chlorobromide silver chloroiodide, siler iodobromide and mixtures thereof. The light-sensitive silver halide can be coarse particles or fine particles, but preferably is fine particles. A preferred particle size of the silver halide is about 0.001 to 1 micron, more preferably about 0.01 to 0.5 micron, in the longer diameter. A suitable amount of the silver halide can range from about 0.001 mole to about 0.5 mole, preferably 0.01 mole to 0.3 mole, per mol of the organic silver salt (a).

The light-sensitive silver halide can be prepared by any conventional procedure known in the field of photography, such as a single jet or double jet method. Examples of silver halides used in this invention include those prepared by a Lippmann process, an ammoniacal process and a thiocyanate or thioether ripening process. The silver halide used can be unwashed or washed, e.g., with water alcohols, etc., to remove soluble salts.

The silver halide used in the invention can be chemically sensitized with a chemical sensitizer such as sulfur, selenium, tellurium, gold, platinum, palladium, a stannous halide, etc., e.g., as disclosed in U.S. Pat. Nos. 1,623,499, 2,399,083 and 3,297,447. The silver halide preferably contains an antifoggant or a stabilizer such as a thiazolium salt, an azaindene, a mercury salt, a urazole, a sulfocatechol, an oxime, a nitron, a nitroindazole, etc., to stabilizer the silver halide to fog, e.g., as disclosed in U.S. Pat. Nos. 2,728,663, 2,839,405, 2,566,263, 2,597,915 and British Pat. No. 623,448.

A pre-prepared silver halide emulsion can be mixed with an oxidation-reduction composition comprising an organic silver salt and a reducing agent, as described in U.S. Pat. No. 3,152,904. According to this method, however, sufficient contact is not attained between the silver halide and the organic silver salt (e.g., as disclosed in U.S. Pat. No. 3,457,075). In order to achieve good contact between the silver halide and the organic silver salt, various techniques can be used. One effective is to mix the materials in the presence of a surface active agent, as described in Japanese Patent Applications (OPI) Nos. 32,926/75 and 32,928/75. According to another method a silver halide is prepared in the presence of a polymer and then mixed with an organic silver salt (for example, as disclosed in U.S. Pat. Nos. 3,705,565; 3,713,833; 3,706,564 and 3,761,273; French Pat. Nos. 2,107,162 and 2,078,586; and Belgian Pat. No. 774,436).

The light-sensitive silver halide employed in the invention can be simultaneously prepared with the preparation of the organic silver salt as disclosed in Japanese Pat. Application (OPI) No. 17,216/75. That is, the silver halide can be prepared by mixing a silver salt (e.g., silver nitrate or a silver complex salt) solution with a solution or dispersion of an organic silver salt-forming compound or a salt thereof and a silver halide forming compound solution, or by mixing a silver halide-forming comound solution and a solution or dispersion of an organic silver salt-forming compound or a salt thereof and a solution of a silver salt such as silver nitrate or a silver complex salt, whereby silver halide is prepared simultaneously with the organic silver salt.

Further, the light-sensitive silver halide employed in the invention can be prepared by a partial conversion of the organic silver salt by contacting a solution or dispersion of a previously prepared organic silver salt with a silver halide forming compound or a sheet material comprising an organic silver salt layer with a silver halide forming compound to provide silver halide. The thus-prepared silver halide is effectively contacted with the organic silver salt to provide preferred results as disclosed in U.S. Pat. No. 3,457,075.

The light-sensitive silver halide forming components which can be employed in this invention include any compounds capable of forming silver halide on reaction with the organic silver salt. Whether a compound can be employed as a silver halide forming component can be determined by a routine test. For example, after mixing a compound for forming a silver halide with the organic silver salt, and, if desired heating, for example, to promote the silver halide forming reaction or to control the practice size of the silver halide, the X-ray diffraction pattern obtained is examined to determine whether diffraction peaks inherent to silver halide are present. If so, the compound can be used.

Examples of silver halide forming components include the following compounds.

1. Inorganic halides:

For example, halides represented by the formula $MX'_n$, wherein M represents H, $NH_4$ or a metal atom, X' represents Cl, Br or I, and $n$ is 1 if M represents H or $NH_4$, or $n$ represents the valence of the metal atom if M represents a metal atom. Examples of suitable metal atoms include lithium, sodium, potassium, rubidium, cesium, copper, gold, beryllium, magnesium, calcium, strontium, barium, zinc, cadmium, mercury, aluminium, gallium, indium, thallium, germanium, tin, lead, antimony, bismuth, chromium, molybdenum, tungsten, manganese, rhenium, iron, cobalt, nickel, ruthenium, rhodium, palladium, osmium, iridium and platinum.

2. Halogen containing metal complexes:

For example, $K_2PtCl_6$, K2PtBr6, HAuCl4, (NH4)2IrCl6, (NH4)3IrCl6, $(NH_4)_2RuCl_6$, $(NH_4)_3RuCl_6$, $(NH_4)_3RhCl_6$ and $(NH_4)_3RhBr_6$, etc.

3. Onium halides: For example, quaternary ammonium halides such as trimethylphenyl ammonium bromide, cetylethyldimethyl ammonium bromide and trimethylbenzyl ammonium bromide, quaternary phosphonium halides such as tetraethyl phosphonium bromide and tertiary sulfonium halides such as trimethyl sulfonium iodide. Further, these onium halides can be used in final coating dispersions for the purpose of decreasing sensitivity or, if desired, decreasing the background density, as described in U.S. Pat. No. 3,679,422.

4. Halogenated hydrocarbons: For example, iodoform, bromoform, carbon tetrabromide and 2-bromo-2-methylpropane, etc.

5. N-halogen compounds:

For example, compounds represented by the following formulae:

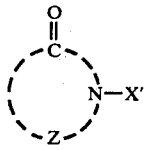
(III)

and

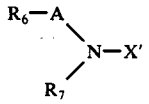
(IV)

wherein X′ represents Cl, Br or I; Z represents the group of atoms necessary to form a 5- or 6-membered ring, wherein the 5- or 6-membered ring may be condensed with another ring; A represents a carbonyl group or a sulfonyl group; and $R_6$ and $R_7$ each represents an alkyl group, an aryl group or an alkoxy group. For example, N-bromosuccinimide, N-bromophthalimide, N-bromoacetamide, N-iodosuccinimide and N-bromophthaladinone, etc. These compounds have been described in West German Patent Application (OLS) No. 2,453,131. In addition, N-halo compounds of benzotriazole and substituted benzotriazoles such as the alkyl, nitro, halo, imido or amino substituted benzotriazoles are also effective. Furthermore, N-bromobenzimidiazoles are suitable.

6. Other halogen containing compounds: For example, triphenylmethyl chloride, triphenylmethyl bromide, 2-bromobutyric acid, 2-bromoethanol and dichlorobenzophenone, etc.

In the above-described processes and the process of the present invention, an improvement in photographic properties, such as an increase in sensitivity and an elimination of thermalfog, etc., can be achieved by ripening, i.e., by allowing the composition to stand at room temperature (about 20° to 25° C) or a higher temperature (30° C to 80° C) for a suitable time (for example, 20 minutes to 48 hours) after the addition of the silver halide forming component.

The silver halide forming compound can be used individually as combinations thereof. A suitable amount of the silver halide forming component is about 0.001 to 0.5 mol, preferably about 0.01 to 0.3 mol, per mol of the organic silver salt employed as a component (a). If the amount is more than about 0.5 mol, color changes (undesirable coloration of the background) occur on allowing the exposed and developed light-sensitive material to stand under normal room illumination. If the amount is less than about 0.001, the sensitivity is reduced.

The reducing agent used as component (c) in this invention is an organic reducing agent which has a reducing ability suitable for forming a silver image as a result of reducing the silver salt oxidizing agent upon heating due to the catalytic action of the silver halide present in the exposed area. Although the suitability of the reducing agent is determined by the organic silver salt with which it is used in combination, reducing agents generally include substituted phenols, substituted or unsubstituted bisphenols, substituted or unsubstituted mono- or bis-naphthols, di- or poly-hydroxy benzenes, di- or poly-hydroxynaphthalenes, hydroquinone monoethers, ascorbic acid or derivatives thereof, 3-pyrazolidones, purazolin-5-ones, reducing saccharides, p-phenylenediamine or the derivatives thereof, reductones, kojic acid, hinokitiol, hydroxylamine, hydroxytetronic acid, hydroxytetronamides, hydroxaminic acids, sulfhydroxaminic acids, hydrazides, indan-1,3-diones, o-oxyphenylglycines and so on. Of these reducing agents, reducing agents which decompose when exposed to light are preferred. Reducing agents which decomposed on exposure are disclosed, for example, in British Pat. No. 1,163,187. In addition, compounds which accelerate photolysis can be used in combination with the reducing agent, such are described in, for example, U.S. Pat. No. 3,589,903; West German Patent Application (OLS) No. 2,434,415. Reducing agents of the blocked bisphenol type can also be effectively usd, such as the compounds disclosed in U.S. Pat. No. 3,756,829.

Specific examples of other reducing agents which can be employed in the practice of the present invention are disclosed in, for example U.S. Pat. Nos. 3,152,904; 3,457,075; 3,531,286; 3,615,533; 3,679,426; 3,672,904; 3,751,252; 3,751,255; 3,782,949; 3,770,448 and 3,773,512; British Pat. No. 1,338,427; Belgian Pat. No. 786,086 and so on.

Examples of suitable reducing agents are as follows:

1. Substituted phenols: Aminophenols, for example, 2,4-diaminophenol, methylaminophenol, p-aminophenol, o-aminophenol, 2-methoxy-4-aminophenol and 2-β-hydroxyethyl-4-aminophenol, etc.; alkyl-substituted phenols, for example, p-t-butylphenol, p-t-amylphenol, p-cresol, 2,6-di-t-butyl-p-cresol, p-ethylphenol, p-sec-butylphenol, 2,3-dimethylphenol, 3,4-xylenol, 2,4-xylenol, 2,4-di-t-butylphenol, 2,4,5-trimethylphenol, o-nonylphenol and p-octylphenol, etc.; other phenols, for example, p-acetophenol, p-acetoacryl-4-methylphenol, 1,4-dimethoxyphenol, 2,6-dimethoxyphenol, chlorothymol, 3,5-di-t-butyl-4-hydroxybenzyl-dimethylamine, and sulfonamidophenols, for example, compounds as described in U.S. Pat. No. 3,801,321; and novalk resin type reaction products for formaldehyde and phenol derivatives (for example, 4-methoxyphenol, m-cresol, o- or p-butylphenol, 2,6-di-t-butylphenol and mixtures thereof, etc.);

2. Substituted or unsubstituted bisphenols: o-bis-Phenols, for example, 1,1-bis-(2-hydroxy-3,5-dimethylphenyl)-3,5-trimethylhexane, bis-(2-hydroxy-3-t-butyl-5-methylphenyl)methane, bis-(2-hydroxy-3,5-di-t-butylphenyl)methane, bis-(2-hydroxy-3-t-butyl-5-ethylphenyl)methane, 2,6-methylene-bis-(2-hydroxy-3-t-butyl-5-methylphenyl)-4-methylphenol, 1,1-bis-(5-chloro-2-hydroxyphenyl)methane, 2,2′-methylene-bis-[4-methyl-6-(1-methylcyclohexyl)phenol], 1,1-bis-(2-hydroxy-3,5-dimethylphenyl)-2-methylpropane, 1,1,5,5-tetrakis-(2-hydroxy-3,5-dimethylphenyl)-2,4-ethylpentane and 3,3',5,5'-tetramethyl-6,6'-dihydroxytriphenylmethane; p-bis-phenols, for example, bisphenol A, 4,4'-methylene-bis-(3-methyl-5-t-butylphenol), 4,4'-methylene-bis-(2,6-di-t-heptylidene)-di-(o-cresol), 4,4'-ethyldene-bis-(2,6-di-tert-butylphenol), 4,4'-(2-butylidene)-di-(2,6-xylenol), 4,4'-(p-methylbenzylidene)-di-(o-cresol), 4,4'-(p-methoxybenzylidene)-bis-(2,6-di-tert-butylphenol), 4,4'-(p-nitrobenzylidene)-di-(2,6-xylenol) and 4,4'-(p-hydroxybenzylidene)-di-(o-cresol); and others, for example, 3,5-di-t-butyl-4-hydroxybenzyldimethylamine, polyphenols such as α,-α'-(3,5-di-t-butyl-4-hydroxyphenyl)dimethylether 2,4,6-tris-(3,5-di-t-butyl-4-hydroxybenzyl)phenol, N,N'-di-(4-hydroxyphenyl)-urea and tetrakis-[methylene-(3,5-di-t-butyl-4-hydroxyhydrocinnamate]methane, diethylstilbestrol, hexestrol, bis-(3,5-di-t-butyl-4-hydroxybenzyl)ether and 2,6-bis-(2'-hydroxy-3'-t-butyl-5'-hydroxybenzyl)-4-methylphenol, etc.

3. Substituted or unsubstituted mono- or bis-naphthols and di- or polyhydroxynaphthalenes: bis-β-Naphthols, for example, 2,2'-dihydroxy-1,1'-binaphthyl, 6,6'-dibromo-2,2'-dihydroxy-1,1'-binaphthyl, 6,6'-dinitro-2,2'-dihydroxy-1,1'-binaphthyl, bis-(2-hydroxy-1-naphthyl)methane and 4,4'-dimethoxy-1,1'-dihydroxy-2,2'-binaphthyl; naphthols, for example, α-naphthol, β-naphthol, 1-hydroxy-4-aminonaphthalene, 1,5-dihydroxynaphthalene, 1,3-dihydroxynaphthalene, 1-hydroxy-2-phenyl-4-methoxynaphthalene, 1-hydroxy-2-methyl-4-methoxynaphthalene, 1-hydroxy-4-methoxynaphthalene, 1,4-dihydroxynaphthalene, methylhydroxynaphthalene, sodium 1-amino-2-naphthol-6-sulfonate, 1-naphthylamine-7-sulfonic acid and sulfonamidonaphthols.

4. Di- or polyhydroxybenzenes and hyroxy-monoethers (e.g., as described in U.S. Pat. No. 3,801,321): Hydroquinone; alkyl substituted hydroquinones, for example, methylhydroquinone, t-butylhydroquinone, 2,5-dimethylhydroquinone, 2,6-dimethylhydroquinone and t-octylhydroquinone, etc.; halogen-substituted hydroquinones, for example, chlorohydroquinone, dichlorohydroquinone and bromohydroquinone, etc.; alkoxy-substituted hydroqinone, for example, methoxyhydroquinone and ethoxyhydroquinone, etc.; other substituted hydroquinones, for example, phenylhydroquinone and hydroquinone monosulfonate, etc.; hydroquinone monoethers, for example, p-methoxyphenol, p-ethoxyphenol, hydroquinone monobenzyl ether, 2-t-butyl-4-methoxyphenol, 2,5-di-t-butyl-4-methoxyphenol, hydroquinone mono-n-propyl ether and hydroquinone mono-n-hexyl ether; and others, for example, catechol, pyrogallol resorcinol, 1-chloro-2,4-dihydroxybenzene, 3,5-di-t-butyl-2,6-dihydroxybenzoic acid, 2,4-dihydroxybenzoic acid, 2,4-dihydroxyphenyl sulfide, methyl gallate, and propyl gallate, etc.

5. Ascorbic acid and derivatives thereof: 1 -Ascorbic acid; isoascorbic acid; ascorbic acid monoesters, for example, ascorbic acid monolaurate, monomyristate, monopalmitate, monostearate and monobehenate; ascorbic acid diesters, for example, ascorbic acid dilaurate, dimyristate, dipalmitate and distearate; and the compounds described in U.S. Pat. No. 3,337,342.

6. 3-Pyrazolines, 3-pyrazolidones and pyrazolones: For example, 1-phenyl-3-pyrazolidone, 4-methyl-4-hydroxymethyl1-phenyl-3-pyrazolidone, the compounds described in British Pat. No. 930,572, and 1-(2-quinolyl)-3-methyl-5-pyrazolone, etc.

7. Reducing saccharides:

For example, glucose and lactose, etc.

8. Aromatic primary amino compounds:

Examples of typical compounds include N,N-diethyl-p-phenylenediamine, 2-amino-5-diethylaminotoluene, 2-amino-5-(N-ethyl-N-laurylamino)-toluene, 4-[N-ethyl-N(β-hydroxyethyl)amino]aniline and 3-methyl-4-amino-N-ethyl-N-(β-hydroxyethyl)aniline, 4-amino-3-methyl-N-ethyl-N-(β-methanesulfoamidoethyl)aniline sesquisulfate monohydrate as described in U.S. Pat. No. 2,193,015, N-(2-amino-5-diethylaminophenylethyl)methanesulfoamide sulfate as described in U.S. Pat. No. 2,592,364, N,N-dimethyl-p-phenylenediamine hydrochloride and 3-methyl-4-amino-N-ethyl-N-methoxyethylaniline as described in Japanese Patent Application (OPI) No. 64,933/73, and the inorganic salts thereof. These compounds have been described in L.F.A. Mason, *Photographic Processing Chemistry pages* 226–229, Focal Press, London (1966).

9. Hydroxylamines:

For example, N,N-di-(2-ethoxyethyl)hydroxylamine, etc.

10. Reductones:

Anhydro-dihydroaminohexose reductones as described in, for example, U.S. Pat. No. 3,679,426, and linear aminoreductones as described in Belgian Pat. No. 786,086.

11. Hydroxamic acids: For example, hydroxamic acids as described in U.S. Pat. Nos. 3,571,252 and 3,751,255.

12. Hydrazides:

For example, hydroxy substituted aliphatic acid aryl hydrazides as described in U.S. Pat. No. 3,782,949.

13. Other compounds: For example, pyrazoline-5-ones as described in U.S. Pat. No. 3,770,448, indan-1,3-diones having at least one hydrogen atom at the 2-position thereof as described in U.S. Pat. No. 3,773,512; amidoximes as described in U.S. Pat. No. 3,794,488, and reducing agents as described in U.S. Pat. No. 3,615,533 and U.S. Pat. No. 3,819,382.

Of these reducing agents, compounds having an alkyl group (e.g., a methyl group, an ethyl group, a propyl group, an isopropyl group, a butyl group or an amyl group) on at least one position adjacent to the position at which a hydroxyl group is bonded to an aromatic nucleus are preferred because they are stable to light and the color change due to exposure to light is small. For example, mono-, bis-, tris or tetrakis phenols having a 2,6-di-tert-butyl-phenol group are preferred examples of reducing agents. Typical examples of these compounds are (i) esters of carboxylic acids derived from phenols having a bulky substituent in at least one ortho-position with monohydric or polyhydric alcohols or phenols, and (ii) esters of alcohols derived from phenols having a bulky substituent in at least one ortho-position or phenols having a bulky susbstituent in at least one ortho-position with mono- or polycarboxylic acids. These esters can be represented by the formulae:

(V)

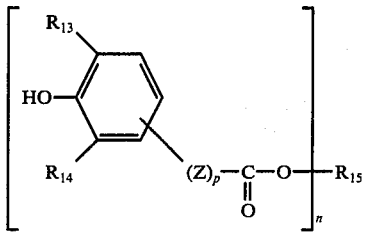

(VI)

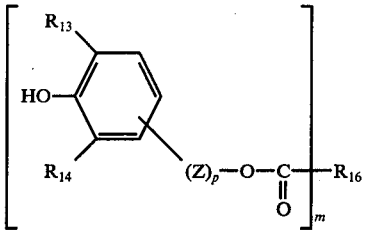

wherein Z is a divalent group containing up to 30 carbon atoms, $R_{13}$ is an alkyl group having 1 to 20 carbon atoms, $R_{14}$ is a hydrogen atom or an alkyl group having 1 to 20 carbon atoms, $R_{15}$ is an alcohol residue, $R_{16}$ is a carboxylic acid residue, n and m each is a positive integer which is equal to the number of alcohol and carboxylic acid residues, respectively, esterified, and p is 0 or 1. Specific examples of these compounds include tetrakis[methylene-(3,5-di-tert-butyl-4-hydroxyhydrocinnamate)]-methane and octadecyl-3-(3',5'-di-tert-butyl-4'-hydroxyphenyl)-propionate.

It has been found that, of these esters, those represented by the following general formula (VII) provide increased image density and a desirable black tone when used in combination with phthalazinones, which can be present in the composition according to the invention as a particularly desirable activator toning agent as described hereinafter.

(VII)

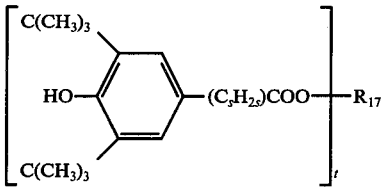

wherein $R_{17}$ represents a residue of a saturated acyclic fatty alcohol represented by the formula $C_dH_{2d+2-t}$, wherein d represents a positive integer of from 1 to 18 and t represents a positive integer of from 1 to $2d+2$, and s represents 1,2,3 or 4.

Further, photodecomposable reducing agents such as ascorbic acid and the derivatives thereof, furoin, benzoin, dihydroxyacetone, glyceraldehyde, rhodizonic acid tetrahydroxyquinone, 4-methoxy-1-naphthol, etc., are preferred. They are decomposed by light even if the light-sensitive materials in which they are present are allowed to stand in the light after development, whereby reduction does not proceed and so no color change occurs. Furthermore, direct positive images can be obtained by destroying the reducing agent upon image-wise exposure as disclosed in U.S. Pat. Nos. 3,756,829 and 3,827,889.

A suitable reducing agent is selected based on the combination of the organic silver salt employed as the component (a) with which the reducing agent is used. For example, a strong reducing agent is suitable for a silver salt such as a silver salt of benzotriazole or silver behenate which is comparatively difficult to reduce, and a weak reducing agent is suitable for a silver salt such as silver caprate or silver laurate which is comparatively easy to reduce. That is, once the organic silver salt is determined, the reducing agent can be selected depending on the organic silver salt. Suitable reducing agents for silver benzotriazole are 1-phenyl-3-pyrazolidones, ascorbic acid, ascorbic acid monoesters and naphthols such as 4-methoxy-2-naphthols. Suitable reducing agents for silver behenate are o-bisphenols and hydroquinone. Suitable reducing agents for silver caprate and silver laurate are substituted tetrakisphenols, p-bisphenols such as substituted bisphenol A, and p-phenylphenol. The selection of an appropriate reducing agent for the organic silver salt can be facilitated by using two or more reducing agents to, e.g., obtain an intermediate reducing capability, if desired.

The amount of the reducing agent used in the invention can vary widely depending on the kind of organic silver salt used, the kind of reducing agent used and the other additives present, but the amount of the reducing agent is generally about 0.05 to about 5 mols, preferably 0.1 to 2 mols, per mol of the organic silver salt.

If desired, an auxiliary reducing agent can be used in combination with the reducing agent employed. The amount of the auxiliary reducing agent used can be varied over a wide range, depending on the reducing power of the primary reducing agent(s) and the reducibility of the organic silver salt used, but a suitable amount of the auxiliary reducing agent generally is from about $10^{-5}$ to about 1 mole, preferably from $10^{-3}$ to 0.8 mole, per mole of the primary reducing agent. Examples of effective combinations of reducing agents include a combination of o- or p-bisphenols and the above described esters selected from the group consisting of esters of mono- or polyhydric phenols or alcohols with carboxylic acids derived from phenols having at least one bulky ortho-substituent, and esters of mono- or polycarboxylic acids with polyhydric phenols having at least one bulky ortho-substituent or alcohols derived from phenols having at least one bulky ortho-substituent. By use of this combination, a heat developable light-sensitive element having reduced thermal fogging, increased whiteness and improved light stability after development can be obtained.

In forming a black image of silver using the heat developable light-sensitive material of the present invention, a color toning agent as an additive is preferably incorporated in the material. The color toning agent is used when it is desired to change the formed inage into a deep color image, particularly into a black image. The amount of color toning agent generally ranges from about 0.0001 mol to about 2 mols, and preferably about 0.0005 mol to about 1 mol, per mol of the organic silver salt. Although the color toning agent which is effective depends upon the organic silver salt and the reducing agent used, in general, heterocyclic organic compounds containing at least two hetero atoms wherein at least one nitrogen atom is present in the ring are used as a color toning agent. These compounds are described in, for example, U.S. Pat. No. 3,080,254. Phthalazone (phthalazinone), phthalic acid anhydride, 2-acetylphthalazinone, 2-phthaloylphthalazinone and substituted phthalazinone derivatives as described in West German Pat. Application (OLS) No. 2,449,252 also can be suitably used in the present invention.

Examples of other effective color toning agents include pyrazolin-5-ones, cyclic imides and quinazolinone, as described in U.S. Pat. No. 3,846,136. For example, phthalimide, N-hydroxyphthalimide, N-potassium phthalimide and silver phthalimide are typical. Silver phthalazinone is also effective as a color toning agent. Other effective color toning agents are the mercapto compounds described in U.S. Pat. No. 3,832,186 and West German Pat. Application (OLS) No. 2,321,217. In addition, the oxazinediones as described in West German Pat. Application (OLS) No. 2,422,012, the phthalazine diones described in West German Pat. Application (OLS) No. 2,449,252, the uracils described in West German Pat. Application (OLS) No. 2,506,320, the N-hydroxynaphthalimides described in U.S. Pat. No. 3,782,941, the substituted phthalimides described in West German Pat. Application (OLS) Nos. 2,140,406, 2,141,063 and U.S. Pat. No. 3,844,797, and the phthalazinone derivatives described in West German Pat. Application (OLS) No. 2,220,618 can be used.

Preferably each component used in the present invention is included in a binder so as to provide a homogeneous film on a support. Although preferred binders are generally hydrophobic, hydrophilic binders can also be used. The binder is transparent or semi-transparent. For example, proteins such as gelatin or gelatin derivatives, cellulose derivatives, polysaccharides such as dextran, natural materials such as gum arabic, vinyl latex compounds which increase the dimensional stability of the photographic materials and synthetic polymers described hereinafter can be used. Preferred synthetic polymers are those described in U.S. Pat. Nos. 3,142,886, 3,193,386, 3,062,674, 3,220,844, 3,287,289 and 3,411,911. Effective polymers include water-insoluble polymers of alkyl acrylates and methacrylates, acrylic acid, sulfoalkyl acrylates or methacrylates, and compounds having a repeating sulfobetaine unit as described in Canadian Pat. No. 774,054. Examples of preferred high molecular weight materials and resins include polyvinyl butyral, polyacrylamide, cellulose acetate butyrate, cellulose acetate propionate, polymethyl methacrylate, polyvinyl pryyolidone, polystyrene, ethyl cellulose, polyvinyl chloride, chlorinated rubber, polyisobutylene, butadiene-styrene copolymers, vinyl chloride-vinyl acetate copolymers, vinyl acetate-vinyl chloride-maleic acid-terpolymers, polyvinyl alcohol, polyvinyl acetate, benzyl cellulose, polyvinyl acetate, acetyl cellulose, cellulose propionate and cellulose acetate phthalate, etc. Of these polymers, polyvinyl butyral, polyvinyl acetate, ethyl cellulose, polymethyl methacrylate and cellulose acetate butyrate are preferred. The most preferred material is polyvinyl butyral. If desired, two or more of these preferred materials can be used as a mixture. The ratio by weight of the binder to the organic silver salt (component (a) generally ranges from about 10:1 to about 1:10 and preferably about 4:1 to about 1:4.

The layers containing each component described herein and other layers in the present invention can be applied to any conventional support. Examples of supports which can be used in the present invention are synthetic resin films such as cellulose nitrate films, cellulose ester films, polyvinyl acetal films, polyethylene films, polyethylene terephthalate films or polycarbonate films, etc., glass plates, paper and metal plates such as an aluminium plate, etc. Partially acetylated materials can also be used. Further, baryta paper, synthetic resin coated paper and water-resistant paper can be used as well. It is further preferred, from the viewpoint of handling, that the support be flexible. Art paper, coated paper and clay processed paper are preferred as paper supports. Paper which has been sized with a polysaccharide, etc., is also preferred. The organic silver salt and the silver halide are each used in the amount such that the sum total of silver amount of both coated on the support is about 0.2 g to about 3 g, preferably about 0.3 g to about 2 g, per $m^2$ of the support. If the amount coated is below about 0.2 g. the image density is low. If the amount coated is above about 3 g, cost is increased while no additional advantages is photographic properties are achieved.

Spectral sensitizing dyes which are known to be effective for gelatin-silver halide emulsions can be used for the heat developable light-sensitive materials of the present invention in order to further increase the sensitivity. Effective spectral sensitizing dyes include cyanine, merocyanine, complex (trinuclear or tetranuclear) cyanine, holopolar cyanine, styryl, hemicyanine, oxonol and hemioxonol dyes. Of the cyanine dyes, those containing a basic nucleus such as a thiazoline, oxazoline, pyrroline, pyridine, oxazole, thiazole, selenazole, or imidazole ring aree suitable. Further, such a nucleus can have an alkyl group, an alkylene group, a hydroxyalkyl group, a sulfoalkyl group, a carboxyalkyl group, an aminoalkyl group or an enamine group as a substituent or can form a condensed carbocyclic group or heterocyclic group. The cyanine dyes can be either symmetric or asymmetric. Further, the dyes can have an alkyl group, a phenyl group, an enamine group or a heterocyclic substituent on the methine chain or the polymethine chain thereof. Particularly, cyanine dyes containing a carboxyl group are effective for sensitization. The merocyanine dyes can contain an acid nucleus such as a thiohydantoin nucleus, a rhodanine nucleus, an oxazolidindione nucleus, a thiazolidindione nucleus, a barbituric acid nucleus, a pyrazolone nucleus or a malonitrile nucleus in addition to the above-described basic nucleus. These acid nuclei can be substituted with an alkyl group, an alkylene group, a phenyl group, a carboxyalkyl group, a sulfoalkyl group, a hydroxyalkyl group, an alkoxyalkyl group, an alkylamino group or a heterocyclic nucleus. Particularly, merocyanine dyes having an imino group or a carboxyl group are effective for sensitization. If desired, these dyes can be used as a combination of two or more thereof. Further, they can be used together with ascorbic acid derivatives, azaindenes, cadmium salts, organic sulfonic acids or supersensitizing additives which do not absorb visible light as described in, for example, U.S. Pat. Nos. 2,933,390 and 2,937,089, etc. Effective sensitizing dyes for the heat developable light-sensitive materials of the present invention include merocyanine dyes containing a rhodanine nucleus, a thiohydantoin nucleus or a 2-thio-2,4-oxazolidindione nucleus as described in U.S. Pat. No. 3,761,279, for example, 3-p-carboxyphenyl-5-[β-ethyl-2-(3-benzoxazolylidenyl)ethylidenyl]rhodanine, 5-{[3-β-carboxyethyl-2-(3-thiazolinylidenyl)ethylidenyl]-3-ethyl}rhodanine, 3-carboxymethyl-5-[3-methylthiazolinylidenyl)-α-ethylethylidenyl]rhodanine, 1-carboxymethyl-5-[(3-ethyl-2-(3H)-benzoxazolylidenyl)ethylidenyl]-3-phenyl-2-thiohydantoin, 5-[(ethyl-2-benzoxazolylidenyl)-1-methylethylidenyl]-3-[(3-pyrrolin-1-yl)propyl]rhodanine and 3-ethyl-5-[(3-ethyl-2-(3H)-benzothiazolylidenyl)isopropylidenyl]-2-thio-2,4-oxazolidindione, etc. Trinuclear merocyanine dyes as described in U.S. Pat. No. 3,719,495 polynuclear aromatic dyes as described in Belgian Pat. No. 788,695, sensitizing dyes for silver iodide as described in West German Pat. Application (OLS) No. 2,328,868, styrylquinoline dyes as described in West German Pat. Application (OLS) No. 2,363,586, rhodacyanine dyes as described in West German Pat. Application (OLS) No. 2,405,713, acid dyes such as 2',7'-dichlorofluoroscein dyes as described in West German Pat. Applications (OLS) 2,404,591, 2,401,892, and 2,422,337 and merocyanine dyes as described in West German Pat. Application (OLS) No. 2,502,906 are other examples of sensitizing dyes which can be similarly used in the present invention. Examples of effective merocyanine dyes which have pyrazolone nuclei are as follows:

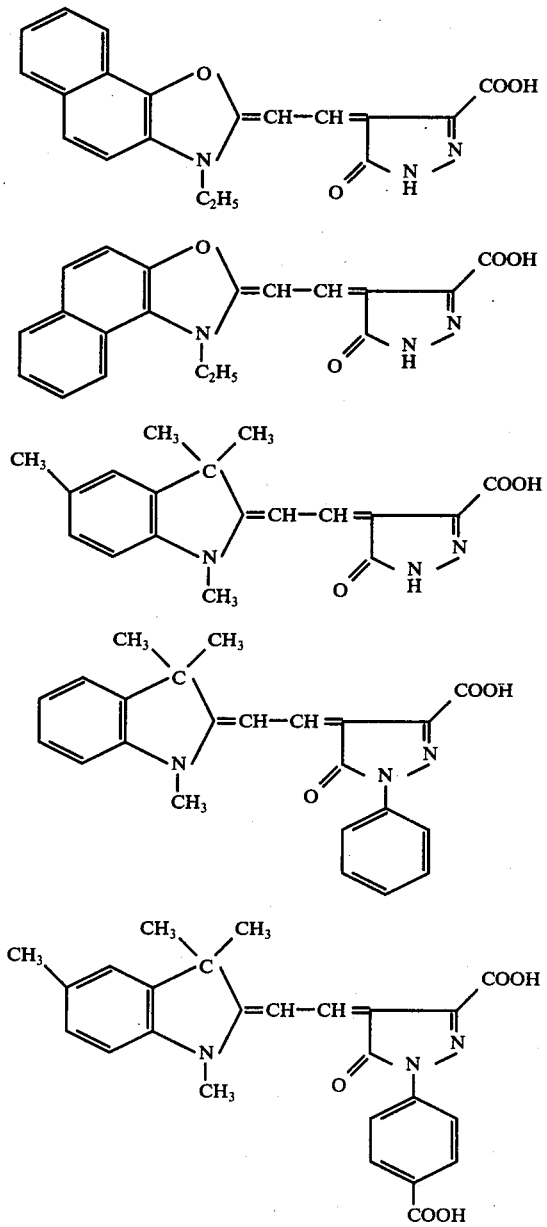

The amount of these dyes generally ranges from about $10^{-4}$ to about 1 mol per mol of the light-sensitive silver halide or the silver halide forming component.

The heat developable light-sensitive materials used in the present invention can have an antistatic layer or an electrically conductive layer. These layers can contain soluble salts such as halides or nitrates, ionic polymers as described in U.S. Pat. Nos. 2,861,056 and 3,206,312 and insoluble inorganic salts as described in U.S. Pat. No. 3,428,451. Further, the heat developable light-sensitive materials can have an evaporation-deposited metal layer. If desired, the heat developable light-sensitive materials of the present invention can contain an antihalation material or an antihalation dye. Preferred examples of such dyes are those dyes which are decolored upon heat development. For example, the dyes described in U.S. Pat. Nos. 3,768,019, 3,745,009 and 3,615,432 are preferred. Further, filter dyes or light absorbing materials as described in U.S. Pat. Nos. 3,253,921 2,527,583 and 2,956,879 can be incorporated into the heat developable light-sensitive materials of this invention.

If desired, the heat developable light-sensitive materials of the present invention can contain a matting agent such as starch, titanium dioxide, zinc oxide, silica, polymer beads such as those described in U.S. Pat. Nos. 2,922,101 and 2,761,245, kalolin or clay, etc. Furthermore, they can contain an optical whitening agent such as the stilbenes, triazines, oxazoles or coumarins as described in, for example, German Pat. Nos. 927,067 and 1,150,274, French Pat. No. 1,530,244 and U.S. Pat. Nos 2,933,390 and 3,406,070. These optical whitening agents can be used as an aqueous solution or as a dispersion.

The heat developable light-sensitive materials of the present invention can additionally contain a plasticizer and a lubricant. For example, glycerin, diols, polyhydric alcohols as described in U.S. Pat. No. 2,960,404, aliphatic acids or esters as described in U.S. Pat. Nos. 2,588,765 and 3,121,060 and silicone resins described in, for example, British Pat. No. 955,061 can be used as plasticizers and lubricants. Furthermore, the light-sensitive materials can contain a surface active agent, for example, saponin and alkylaryl sulfonates described in, for example, U.S. Pat. No. 2,600,831, ampholytic compounds described in, for example, U.S. Pat. No. 3,133,816 and addition products of glycidol and alkyl phenols described in, for example, British Pat. No. 1,022,878. Hardenable layers of the heat developable light-sensitive layers used in the present invention can be hardened by organic or inorganic hardening agents. These hardening agents can be used individually or as a combination of two or more thereof. Preferred hardening agents are aldehydes, blocked aldehydes, ketones, carboxylic acids, carbonic acid derivatives, sulfonic acid esters, sulfonyl halides, vinyl sulfonyl esters, active halogen compounds, epoxy compounds, aziridines, active olefins, isocyanates, carbodiimides and polymeric hardening agents such as dialdehyde starch, etc. Further, additives can be used to increase the density of the resulting images. For example, non-aqueous polar organic solvents such as compounds having a $$-\underset{\underset{C}{\|}}{C}-,\ -\underset{\underset{O}{\|}}{S}-\ \text{or}\ -SO_2-$$

group as described in U.S. Pat. No. 3,667,959, for example, tetrahydrothiophene-1,1-dioxide, 4-hydroxybutanoic acid lactone and methylsulfinyl methane are effective. Zinc, cadmium and copper acetates as described in U.S. Pat. No. 3,708,304 are also effective. Furthermore, compounds containing water of crystallization as described in U.S. Pat. No. 3,635,719, acid salts of amines and compounds which become alkaline on heating such as metal oxides or hydroxides are effective as the materials for accelerating development. It is possible to use polyalkylene glycols together with mercaptotetrazole in order to improve the sensitivity, contrast and image density as described in U.S. Pat. No. 3,666,477.

Various methods can be utilized in order to further prevent the generation of thermal fog of the heat developable light-sensitive materials of the present invention. One method comprises using mercury compounds, as described in U.S. Pat. No. 3,589,903. Further, it is possible to form direct positive images using mercury compounds as described in U.S. Pat. No. 3,589,901. Furthermore, the mercury compounds can be used together with color forming couplers in order to form stabilized color images as described in U.S. Pat. No. 3,764,328. A second method for preventing the generation of thermal fog is described in West German Patents (OLS) Nos. 2,326,865, 2,402,161 and 2,364,630, wherein N-halo compounds such as N-halosuccinimides or N-haloacetamides are used. Other methods for preventing the generation of thermal fog are described in U.S. Pat. No. 3,645,739, West German Patent Application (OLS) No. 2,445,038, and Japanese Patent Applications (OPI) Nos. 89,720/73 and 125,016/74, wherein higher aliphatic acids such as lauric acid, myristic acid, palmitic acid, stearic acid or behenic acid, etc., tetrahalophthalic acids or the anhydrides thereof, aryl sulfonic acids such as benzene sulfonic acid or p-toluene sulfonic acid, and lithium salts of higher aliphatic acids such as lithium stearate, etc., are used as acid stabilizing agents. Other effective acid stabilizing agents include salicyclic acid, p-hydroxybenzoic acid, tetrabromobenzoic acid, tetrachlorobenzoic acid, p-acetamidobenzoic acid, alkyl substituted benzoic acids such as p-t-butylbenzoic acid, phthalic acid, isophthalic acid, trimellitic acid, pyromellitic acid, diphenic acid, and 5',5'-methylene-bis-salicyclic acid. These acid stabilizing agents not only prevent the generation of thermal fog but also sometimes have the functions of preventing discoloration when exposed to white light, increasing the image density or improving the shelf life (the property that the photographic properties of the light-sensitive material possessed just after production are maintained after storage). Other compounds which are effective for preventing generation of heat fog are benzotriazole and derivatives thereof, thiouracils, for example, 2-thiouracils represented by the formula (VIII):

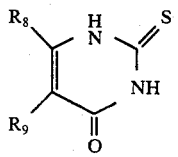

(VIII)

wherein $R_8$ represents a hydrogen atom, a hydroxyl group, an alkoxy group, a halogen atom, an unsubstituted or substituted lower alkyl group, a benzyl group, an allyl group, an amino group, a nitro group or a nitroso group, and $R_9$ represents a hydrogen atom, a hydroxyl group, a halogen atom, an amino group, an acetamido group an unsubstituted or substituted alkyl group having 1 to 22 carbon atoms, an aryl group, such as a phenyl group, or a substituted aryl group, mercapto compounds such as 1-phenyl-5-mercaptotetrazole, azole thioethers or blocked azolethiones, and peroxides or persulfates as described in West German Patent Application (OLS) No. 2,500,508. Also, effective prevention of thermal fog or an improvement in photographic properties such as sensitization can be achieved if chromium salts, rhodium salts, copper salts, nickel salts, cobalt salts and complex salts or rhodium, iron or cobalt are present during formation or before formation of the silver halide.

In order to prevent discoloration by light of the processed light-sensitive material (the phenomenon in which the unexposed area of the light-sensitive material after processing is discolored gradually by light when exposed to normal room illumination), it is possible to use stabilizer precursors such as azole thioethers or blocked azolethiones as described in U.S. Pat. No. 3,839,049, tetrazolyl thio compounds as described in U.S. Pat. No. 3,700,457 and light-sensitive halogen-containing organic oxidizing agents as described in U.S. Pat. No. 3,707,377.

In addition, it is possible to use light absorbing dyes as described in British Pat. No. 1,261,102, particularly, for transmission light-sensitive materials in order to improve their resolving power. Further, it is possible to use leuco dye compounds described in, for example, West German Pat. Application (OLS) No. 2,446,892 in order to improve shelf life. It is also possible to increase the whiteness by blueing the elements using blue dyes so that the color stain due to the dyes can be reduced.

Further, it is possible in some cases to stabilize the processed light-sensitive materials to light or heat. Effective methods include the process described in U.S. Pat. No. 3,617,289 which comprises stabilizing the materials using a solution containing mercapto compounds and the method described in West German Patent Application (OLS) No. 2,443,292 which comprises providing a laminate containing a stabilizing agent.

Further, it is possible to provide, if desired, a top-coating polymer layer on the light-sensitive layer in order to enhance the transparency of the heat developable light-sensitive layer, to increase the image density and to improve the shelf life, as described in West German Pat. Application (OLS) No. 2,323,452. A preferred thickness for the top coating polymer layer ranges from about 1 micron to about 20 microns. Examples of polymers suitable for the top-coat polymer layer include polyvinyl chloride, polyvinyl acetate, vinyl acetate-vinyl chloride copolymers, polystyrene, polymethyl methacrylate, methyl cellulose, ethyl cellulose, cellulose acetate butyrate, cellulose acetate, polyvinylidene chloride, cellulose propionate, cellulose acetate phthalate, polycarbonate, cellulose acetate propionate and polyvinyl pyrrolidone, etc. A top coat polymer layer containing a material such as kaolin, silica or a polysaccharide such as starch therein, as described in Belgian Pat. No. 798,367 and Japanese Patent Application (OPI) No. 46,316/75, provides the heat developable light-sensitive material with the ability to be written upon with a ball-point pen or a pencil. Further, the top coat polymer layer can contain a filter dye, an ultraviolet light absorbing agent or an acid stabilizing agent such as higher aliphatic acids, etc.

The heat developable light-sensitive layers, the top coat polymer layer, a subbing layer, a back layer and other layers used in the present invention can be coated on a support using various coating methods. Examples of such methods are a dip-coating method, an air-knife coating method, a curtain coating method and a hopper coating method. If desired, two or more layers can be coated at the same time using the methods described in U.S. Pat. No. 2,761,791 and British Pat. No. 837,095.

The heat developable light-sensitive materials of the present invention generally have the characteristic that the photographic properties thereof are easily deteriorated by moisture. Therefore, when the prepared light-sensitive materials are packed and sent into the trade as commodities, a drying agent, as described in West German Patent Application (OLS) No. 2,422,040, is generally packed with the materials.

The heat developable light-sensitive materials of the present invention can have a subbing layer between the support and the heat developable light-sensitive layer. Examples of binders which can be used for such a subbing layer include various polymers as described hereinbefore. For example, polyvinyl butyral, polyacrylamide, cellulose acetate butyrate, cellulose acetate propionate, polymethyl methacrylate, polystyrene, polyvinyl pyrrolidone, ethyl cellulose, polyvinyl chloride, chlorinated rubber, polyisobutylene, butadiene-styrene copolymers, vinyl chloride-vinyl acetate copolymers, vinyl acetate-vinyl chloride-maleic acid terpolymers, polyvinyl alcohol, polyvinyl acetate, cellulose acetate, cellulose propionate, cellulose acetate phthalate, gelatin, gelatin derivatives and polysaccharides, etc., can be used. It is possible to improve the photographic properties such as light-discoloration or thermal fog, etc., by incorporating aliphatic acids or metal salts thereof into the subbing polymer layer. Further, it is possible to prevent permeation of solvents by incorporating pigments such as clay into the subbing layer. In addition, a matting agent such as silica, kaolin, titanium dioxide or zinc oxide can be added to the subbing layer. Further, a non-electrolytic deposition layer composed of a conductive metal as described in U.S. Pat. No. 3,748,137 can be present. It is also possible to improve the moisture resistance or to prevent curling in case of a paper support by providing a hydrophobic polymer layer on the back of the support.

The heat developable light-sensitive materials of the present invention are cut to appropriate sizes and are developed by heating after image exposure.

The light-sensitive materials of the invention can be preheated before exposure to light as described above (to about 80° C to 140° C), if desired, to increase sensitivity.

Light sources suitable for image-wise exposure are tungsten lamps, fluorescent lamps used for exposing diazotype light-sensitive materials, mercury lamps, xenon lamps, cathode ray tube (CRT) light sources and laser light sources, etc. As originals, not only line images, such as drawings, but also photographic images having gradation can be used. Further, it is possible to directly photograph people and landscapes using a camera. The light-sensitive materials can be printed by direct contact of the light-sensitive material with the original, or can be printed using a relfection printing method or using an enlarged printing method. Although exposure depends upon the sensitivity of the light-sensitive materials, an exposure of about 10 lux.-second is required for high speed sensitive materials and an exposure of about $10^4$ lux.second is required for low speed sensitive materials. Exposure times of from about $10^{-9}$ to about $10^2$ sec., preferably $10^{-7}$ - 10 sec, are generally used, though these ranges are not limitative.

The thus image-exposed light-sensitive materials can be developed simply by heating (e.g., to about 80° C to about 180° C, preferably about 100° C to about 150° C). The heating time can be suitably, for example, about 1 second to 60 seconds. The heating time, of course, is related to the heating temperature employed. In general, a suitable heating time is about 5 seconds to about 40 seconds at 120° C, about 2 seconds to about 20 seconds at 130° C and about 1 second to about 10 seconds at 140° C.

Various means can be used for heating. For example, the light-sensitive material can be contacted with a simple heated plate or with a heated drum or, if desired, it can be passed through a heated space. Further, the heating can be carried out by high frequency heating or by laser beams. In order to prevent a bad odor from being emitted on heating, the processing devices can be equipped with a deodorizer. It is also possible to incorporate certain perfumes so as to mask any bad odor of the light-sensitive materials which might be formed.

The preparation of heat developable light-sensitive materials of the invention will be illustrated by reference to the following examples.

The addition of all components occurred with mixing, all thicknesses were dry thickness, all processings were at room temperature and atmospheric pressure, all percentages, parts and the like were by weight, unless otherwise indicated.

EXAMPLE 1

1.9 g of sodium hydroxide was dissolved in 100 ml of water, which was mixed with a solution of 12 g of lauric acid dissolved in 100 ml of toluene to form an emulsion (at 25° C).

Then, an aqueous solution of 8.5 g of silver nitrate disslved in 50 ml of water (50° C was added thereto. When the mixed solution was allowed to stand for 5 minutes, it separated into a toluene phase containing silver laurate and an aqueous phase. After removing the aqueous phase, the toluene phase was dispersed in 200 ml of ethanol, and silver laurate was collected by centrifugation. 12 g of spindle-shaped silver laurate crystals having a major diameter of about 3 microns was obtained.

6 g (about 1/50 mol) of the thus obtained silver laurate and 12 g of polyvinyl butyral (12 g of ethyl cellulose could be used with similar results) were dispersed in 70 g of ethyl alcohol to prepare a polymer dispersion of the silversalt (polymer dispersion A).

Polymer dispersion A was kept at 50° C, and, while stirring, 15 ml of an acetone solution containing 1.1 wt% N-bromacetamide (silver halide-forming component) was added thereto in 8 equal amounts (15/8 ml per time) at 5 minutes intervals. Then, heating was effected for 19 minutes at 50° C. The resulting mixture is designated as mixture A. Thereafter, mixture A was kept at 30° C, and with stirring, the following components were successively added at 5 minute intervals in their recited order to prepare a Coating Composition A-1.

1. mercocyanine dye (sensitizing dye) of the following formula (0.025 wt % 2-methoxy ethanol solution)

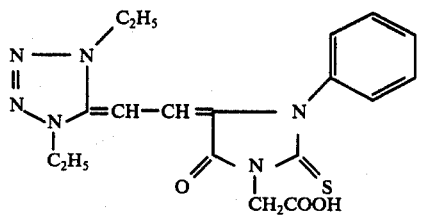

2. rosin (TESTN 906 A 3111 produced by Kanto Chemical Co., Ltd.; acid value about 165) (2 wt % ethanol solution)—25 ml 3. phthalazinone (color toning agent) (23 wt % methanol solution)—35 ml 4. compound (reducing agent) of the following formula (20 wt % acetone solution) —28 ml

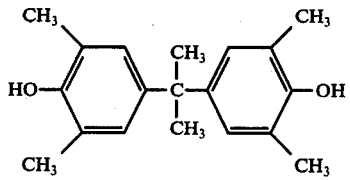

For comparison, a Coating Composition A-2 was prepared in the same manner as Coating Composition A-1 except for adding 2' lauric acid (3 wt % ethanol solution)—25 ml between the addition of (1) and (2).

Moreover, Coating Composition A-3 was prepared in the same manner as Coating Composition A-1 except for adding 2. lauric acid (3 wt % ethanol solution)—25 ml in place of rosin (2) used in the composition A-1.

Finally, Coating Composition A-4 was prepared in the same mammer as Coating Composition A-1 except for adding 2. mercury acetate (0.5 wt % ethanol solution)—10 ml in place of rosin (2) used in Coating Composition A-1.

Each of the four Coating Compositions thus prepared was coated on art paper in an amount of 0.3 g/m$^2$ based on silver and dried to prepare four thermally developable light-sensitive materials which were designated Samples A-1, A-2, A-3 and A-4, respectively.

These samples were exposed to light at $3 \times 10^3$ lux. sec. through an optical wedge and developed by heating at a temperature of 140° C for 10 seconds to obtain a black image.

The reflection density of the image was then measured. Herein, sensitivity was determined using the reciprocal of the amount of exposure required to give a reflection density of fog + 0.1. The measured values of relative sensitivity when the sensitivity of Sample A-4 was takened as 100, thermal fog and Dmax are shown in Table 1.

Table 1

| Sample | A-1 | A-2 | A-3 | A-4 |
|---|---|---|---|---|
| Sensitivity | 195 | 230 | 95 | 100 |
| Thermal Fog | 0.11 | 0.08 | 0.35 | 0.12 |
| Dmax | 1.33 | 1.35 | 1.29 | 1.31 |

It can be seen from the results shown in Table 1 that Samples A-1and A-2 of this invention showed less thermal fog, as well as higher sensitivity.

Next, identical Samples to "fresh" Samples A-1 to A-4 were put in sealed containers at 50° C for 24 hours and then subjected to exposure, development and analysis (sensitometry) under the same conditions as above. The results obtained are shown in Table 2.

Table 2

| Sample | A-1 | A-2 | A-3 | A-4 |
|---|---|---|---|---|
| Sensitivity* | 170 | 205 | 60 | 75 |
| Thermal Fog | 0.12 | 0.09 | 0.70 | 0.16 |
| Dmax | 1.28 | 1.30 | 1.25 | 1.26 |

*Values when the sensitivity of Sample A-4 in the fresh state is set as 100.

It can be seen from the results shown in Table 2 that Samples A-1 and A-2 of this invention had an excellent shelf life.

It is apparent that the compounds of this invention have excellent effects.

COMPARATIVE EXAMPLE

Sample X was further produced in the same manner as for Sample A-1 except for using 25 ml of a 3 wt % toluene solution of Pensel A (rosin esterified with pentaerythritol; produced by Arakawa Rinsan, acid value; about 20) in place of the rosin (produced by Kanto Kagaku; acid value: about 165). The sample was then subjected to sensitometry under the same conditions as in Example 1. The results obtained are showing the following table, along with the results for Sample A-4 as in Example 1.

| Sample | A-1 | A-4 | X |
|---|---|---|---|
| Thermal Fog | 0.11 | 0.35 | 0.37 |
| Sensitivty | 195 | 100 | 98 |
| Dmax | 1.33 | 1.31 | 1.30 |

It is apparent from the results in the above table that the use of a rosin having a low acid value cannot provide a sufficient fog inhibiting effect.

EXAMPLE 2

Sample A-5 was prepared in the same mammer as Sample A-1 and Sample A-6 was prepared in the same manner as Sample A-2, with the exception, for both cases, of adding.

2. abietic acid (3 wt % ethanol solution)-13 30 ml in place of the rosin (2) used in Example 1.

Samples A-5 and A-6, and Sample A-4 prepared in Example 1, were subjected to sensitometry under the same conditions as in Example 1. The measured values of relative sensitivity when the sensitivity of Sample A-4 was set as 100, thermal fog and Dmax are shown in Table 3.

Table 3

| Sample | A-5 | A-6 | A-4 |
|---|---|---|---|
| Sensitivity | 180 | 210 | 100 |
| Thermal Fog | 0.10 | 0.08 | 0.13 |
| Dmax | 1.36 | 1.39 | 1.35 |

It can be concluded from the results shown in Table 3 that Samples A-5 and A-6 of this invention had excellent sensitivity and low thermal fog.

EXAMPLE 3

An aqueous solution of 0.8 g of cetylethyldimethylammonium bromide dissolved in 100 ml of water (85° C) was mixed with 100 ml of toluene. To this, a solution of 0.425 g of silver nitrate dissolved in 10 ml of water was added thereto to produce silver bromide at 25° C. The silver bromide was present in an emulsified state. There was then added thereto an emulsion prepared by mixing a solution of 12 g of lauric acid dissolved in 100 ml of toluene with a solution of 1.9 g of sodium hydroxide dissolved in 100 ml of water (25° C).

Thereafter, a solution of 8.5 g of silver nitrate dissolved in 50 ml of water was added thereto to produce silver laurate at 25° C. A mixture in which silver bromide and silver laurate were in contact with each other was thus obtained.

The silver bromide and silver lauride were collected by centrifugation (about 30 g in wet condition (i.e., containing solvent) ) and then dispersed in 200 g of an ethanol solution containing 30 g of polyvinyl butyral as a binder by a mixer to form a polymer dispersion of the silver salts (Mixture B).

This polymer dispersion of the silver salts was kept at 20° C, and the following components were successively added thereto in their recited order at 5 minute intervals to prepare Coating Composition B-1.

1. dye of the following chemical formula
(0.025 wt % methanol solution)—24 ml

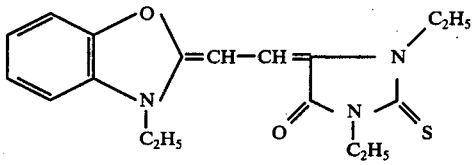

2. pimaric acid
(3% ethanol solution)—50 ml
3. phthalazinone (color toning agent)
(3 wt % methanol solution)—120 ml
4. tetrakis-[methylene-3,5-di-t-butyl-4-hydroxyhydrocinnamate) ]-methane
(20 wt % acetone solution)—90 ml For comparison, Coating Composition B-2 was prepared in the same manner as for the preparation of the Coating Composition B-1 except for adding 2. stearic acid
(5 wt % toluene solution)—40 ml instead of pimaric acid (2).

Moreover, for comparison, Coating Composition B-3 was prepared in the same mammer as Coating Composition B-1 except for adding 2' stearic acid
(5 wt % toluene solution)—40 ml between the addition of (1) and (2) in the preparation of Coating Composition B-1 so that the sample contained both pimaric and stearic acid.

Each of the three Coating Compositions thus prepared was coated on art paper in an amount of 0.5 g/m$^2$ based on silver amount and then dried. Furthermore, a 10 wt % acetone solution of cellulose diacetate containing 1.5 wt % of finely powdered silica having an average particle size of about b 2$\mu$ was coated thereon to provide an overcoating layer of a thickness of 1.5 $\mu$. These three thermally developable light-sensitive materials are designated Samples B-1, B-2 and B-3, respectively.

The samples were subjected to sensitometry under the same conditions as in Example 1 except for carrying out the development at a temperature of 120° C for 45 seconds. Relative sensitivity, Dmax and thermal fog were determined for each of the samples, and the results obtained are shown in Table 4.

Table 4

| Sample | B-1 | B-2 | B-3 |
|---|---|---|---|
| Sensitivity* | 145 | 100 | 180 |
| Thermal Fog | 0.15 | 0.51 | 0.12 |
| Dmax | 0.96 | 0.98 | 1.01 |

*Relative sensitivity when the sensitivity of Sample B-3 is set as 100.

From the results shown in Table 4, it can be concluded that Samples B-1 and B-2 of this invention were excellent in thermal fog and sensitivity.

EXAMPLE 4

A solution of 11 g of capric acid dissolved in 100 ml of butyl acetate was mixed with a solution of 1.8 g of sodium hydroxide dissolved in 150 ml of water, and 0.25 g of ammonium bromide and 0.02 g of ammonium iodide were then added thereto, all at 25° C. The resulting mixture was stirred by a homogenizer rotating at 1,500 r.p.m. to emulsify the mixture. While stirring, an aqueous solution of 8.5 g of silver nitrate dissolved in 50 ml of water was added to the emulsion to form silver bromoiodide and silver caprate at 25° C. When the reaction system was allowed to stand, it separated into two phases. After the aqueous phase was removed, the butyl acetate phase containing silver caprate and silver bromoiodide was dispersed in 180 g of a 15 wt % isopropanol solution of polyvinyl butyral to prepare a polymer dispersion of the silver salts, which was designated mixture C.

This polymer dispersion was kept at 15° C, and, while stirring, the following components were sequentially added at 5 minute intervals in their recited order to prepare Coating Composition C-1.

1. Staybelite (hydrogenated rosin produced by Arakawa Rinsan Co., acid value: about 160)
(2 wt % ethanol solution)—80 ml
2. p-phenylphenol (reducing agent)
(2 wt % acetone solution)—50 ml For comparison, Coating Composition C-2 was prepared in the same manner as above except for adding 1. palmitic acid
(4 wt % toluene solution)

in place of rosin (1) described above.

Each of the Coating Compositions was coated on a claycoated paper in an amount of 0.6 g/m$^2$ based on silver amount to make two thermally developable light-sensitive materials, which were designated Samples C-1 and C-2, respectively.

These light-sensitive materials were subjected to sensitometry under the same conditions as in Example 1 except for subjecting them to an exposure of 300,000 CMS and for developing at 115° C for 30 seconds. Sample C-1 showed higher sensitivity and less thermal fog than Sample C-2.

EXAMPLE 5

3.4 g of behenic acid was dissolved in 100 ml of benzene at 60° C. The temperature of the resulting solution was then maintained at 60° C and while stirring, 100 ml of water was added to form an emulsion. There was then added thereto an aqueous solution (the temperature of which was 10° C) prepared by adding an aqueous ammonia solution to about 80 ml of an aqueous solution containing 1.7 g of silver nitrate to form a silver ammonium complex salt at 25° C (28% aqueous ammonia; added until the solution became transparent due to the production of a silver ammonia complex salt) whereafter, water was added to make the total 100 ml.

There were thus obtained fine crystals of silver behenate (long axis ca. 1~2 μ). When the resulting mixture was kept at ambient temperature (25° C) for 20 minutes, it separated into an aqueous phase and a benzene phase. After removing the aqueous phase, the benzene phase was washed by adding 400 ml of water and then the water removed by decantation. 400 ml of methanol was then, added, and silver behenate collected by centrifugation. There was thus obtained 4 g of spindle-shaped silver behenate about 1 micron in major diameter and about 0.05 microns in minor diameter.

2.3 g of this silver behenate was dispersed in 20 ml of an ethanol solution containing 2.5 g of polyvinyl butyral. To the resulting polymer dispersion of the silver salt, 1 ml of a 2.5 wt % methanol solution of ammonium bromide (silver halide-forming component) was added, and then heating effected at 50° C for 10 minutes. The resulting dispersion is denoted as mixture D.

To mixture D, the following components were successively added in their recited order at 5 minute intervals at 25° C to prepare Coating Composition D-1.

1. sensitizing dye of the following chemical formula
(0.025 wt % 2-methoxy ethanol solution) — 1 ml

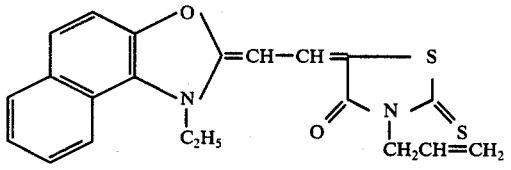

2. behenic acid
(5 wt % toluene solution) — 15 ml
3. rosin (produced by Arakawa Rinsan Co., acid value: 170)
(2wt % ethanol solution) — 4 ml
4. 2,2'-methylenebis(6-t-butyl-4-methylphenol) (reducing agent)
(25 wt % acetone solution) — 3 ml
5. phthalazinone (color toning agent)
(3 wt % methanol solution) — 5 ml For comparison, Coating Composition D-2 was prepared in the same manner as above except for adding
3. tetrabromophthalic anhydride
(0.6 wt % methanol solution) — 2 ml
in place of rosin (3).

Each of the two Coating Compositions thus prepared was coated on a polyethylene terephthalate film in an amount of 1.7 g/m² based on silver amount and dried to form two thermally developable light-sensitive materials which were denoted Samples D-1 and D-2 respectively.

Both Samples were subjected to sensitometry under the same conditions as in Example 1 except for subjecting them to an exposure of 300,000 CMS and a developing at 120° C for 13 seconds. Density however, was measured as transmission density in the Example. The results obtained are shown in Table 5, setting the sensitivity of Sample D-2 as 100 for relative sensitivity measurements.

Table 5

| Sample | D-1 | D-2 |
|---|---|---|
| Sensitivity | 550 | 100 |
| Thermal Fog | 0.15 | 0.43 |
| Dmax | 2.3 | 1.9 |

From the results shown in Table 5, it can be concluded that Sample D-1 of this invention was excellent in sensitivity and thermal fog.

EXAMPLE 6

Polymer dispersion A prepared in the same manner as in Example 1, was kept at 50° C, and, while stirring, 15 ml of an acetone solution containing 1.1 wt % of N-bromoacetamide (silver halide-forming component) was added thereto in 8 equal portions (15/8 ml per time) at 5 minute intervals. Then, heating was effected for 90 minutes at 50° C. The resulting mixture was designated mixture A. Thereafter, mixture A was kept at 30° C, and with stirring, the following components were successively added thereto in their recited order at 5 minute intervals to prepare Coating Composition E-1.

1. merocyanine dye (sensitizing dye) of the following formula
(0.025 wt % methyl cellosolve solution) — 10 ml

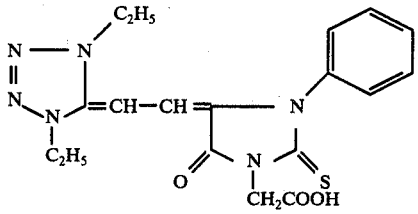

2. sodium benzenesulfinate
(0.1 wt % methanol solution) — 6 ml
3. rosin (TESTN 906 A 3111 made by Kanto Chemical Co., Ltd.; acid value: about 165)
(3 wt % ethanol solution) — 25 ml
4. phthalazinone (color toning agent)
(3 wt % methanol solution) — 35 ml
5. compound (reducing agent) of the following formula
(20 wt % acetone solution) — 28 ml

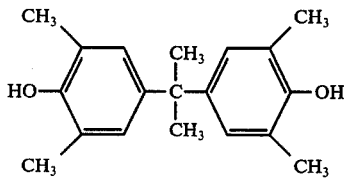

For comparison, Coating Composition E-2 was prepared in the same manner as Coating Composition E-1 except for omitting sodium benzenesulfinate (2). Moreover, Coating Composition E-3 was prepared in the same manner as Coating Composition E-1 except for omitting rosin (3). In addition, Coating Composition E-4 was prepared in the same manner as Coating Composition E-1 except for adding
2. mercury acetate
(0.5 wt % ethanol solution) — 10 ml in place of sodium benzenesulfite (2) and rosin (3) which were both incorporated in Coating Composition E-1.

Each of the four Coating Compositions thus prepared was coated on art paper in an amount of 0.3 g/m² based on silver amount and dried to prepare four thermally developable light-sensitive materials which were designated Samples E-1, E-2, E-3 and E-4, respectively.

These samples were exposed to light at $3 \times 10^3$ lux.-sec through an optical wedge and developed by heating at a temperature of 140° C for 10 seconds to give a black image.

The reflection density of the images was then, measured. The sensitivity was determined using the reciprocal of the amount of exposure required to give a reflection density of fog + 0.1. The measured values of relative sensitivity when the sensitivity of Sample E-4 is expressed as 100, thermal fog and Dmax are shown in Table 6.

Table 6

| Sample | E-1 | E-2 | E-3 | E-4 |
|---|---|---|---|---|
| Thermal Fog | 0.09 | 0.11 | 0.20 | 0.12 |
| Sensitivity | 130 | 190 | 65 | 100 |
| Dmax | 1.32 | 1.36 | 1.15 | 1.31 |

Next, fresh Samples identical to Samples E-1 to E-4 were placed in a container sealed therein and kept at a relative humidity of 80%, at 50° C for 24 hours. The samples were subjected to sensitometry under the same conditions as above.

The results obtained are shown in Table 7.

Table 7

| Sample | E-1 | E-2 | E-3** | E-4 |
|---|---|---|---|---|
| Thermal Fog | 0.15 | 0.85 | 0.21 | 0.20 |
| Sensitivity* | 58 | 50 | 18 | 33 |
| Dmax | 1.19 | 1.25 | 0.60 | 0.74 |

*Values when the sensitivity of Sample E-4 in the fresh state is set as 100
**Sample E-3 provided a red-brown image; others Samples provided a black-brown image It is apparent from the results in Table 6 and Table 7 that the combination of rosin and a sulfinate shows a remarkably excellent effect regarding shelf life.

EXAMPLE 7

Thermally developable light-sensitive materials E-5 to E-7 were prepared in the same manner as in Example 6 except for using 2. potassium p-toluenesulfinate
(0.1 wt % methanol solution) — 8 ml in place of sodium benzenesulfinate (2) used in Example 6 and using 3. abietic acid
(3 wt % ethanol solution) — 40 ml in place of rosin (3) used in Example 6.

The features of additives contained in the samples E-5 to E-7 are shown in Table 8.

Table 8

| | E-5 | E-6 | E-7 |
|---|---|---|---|
| (2) potassium p-toluenesulfite | Present | Absent | Present |
| (3) abietic acid | Present | Present | Absent |

Samples E-5 to E-7 were subjected to sensitometry under the same conditions as in Example 6. The results obtained are shown in Table 9.

Table 9

| Sample | E-5 | E-6 | E-7 |
|---|---|---|---|
| Thermal Fog | 0.08 | 0.10 | 0.14 |
| Sensitivity* | 121 | 175 | 59 |
| Dmax | 1.40 | 1.45 | 1.31 |

*Value when the sensitivity of Sample E-4 was set as 100

Next, fresh Samples identical to Samples E-5 to E-7 were placed in a container and kept at a relative humidity of 80% at 50° C for 24 hours; the Samples were then subjected to sensitometry under the same conditions as above. The results obtained are shown in Table 10.

Table 10

| Sample | E-5 | E-6 | E-7** |
|---|---|---|---|
| Thermal Fog | 0.14 | 0.77 | 0.23 |
| Sensitivity* | 52 | 49 | 16 |
| Dmax | 1.23 | 1.18 | 0.59 |

*Value when the sensitivity of Sample E-4 in the fresh state was set as 100
**Sample E-7 provided a red-brown image. Others provided black-brown images.

It is apparent from the results in Table 9 and Table 10 that the combination of abietic acid and a sulfinate shows an excellent effect on shelf life.

EXAMPLE 8

Thermally developable light-sensitive materials E-8 to E-11 were prepared in the same manner as in Example 6 except for using:

5. a reducing agent

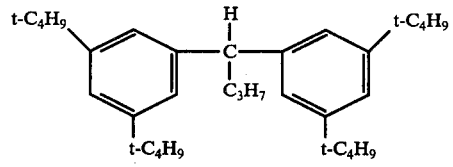

(20 wt % acetone solution) — 35 ml in place of reducing agent (5) of Example 6 which was:

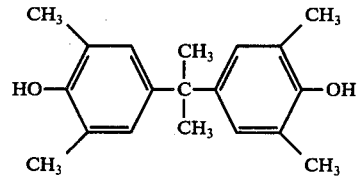

The features of the additives contained in Samples E-8 to E-11 are shown in Table 11.

Table 11

| Sample | E-8 | E-9 | E-10 | E-11 |
|---|---|---|---|---|
| (2) sodium benzenesulfite | Present | Absent | Present | Absent |
| (3) rosin | Present | Present | Absent | Absent |
| (2) mercury acetate | Absent | Absent | Absent | Present |

Samples E-8 to E-11 were subjected to sensitometry under the same conditions as in Example 6 except for changing the thermal development conditions from 140° C for 10 seconds to 120° C for 10 seconds. The results obtained are shown in Table 12.

Table 12

| Sample | E-8 | E-9 | E-10 | E-11 |
|---|---|---|---|---|
| Thermal Fog | 0.07 | 0.10 | 0.25 | 0.13 |
| Sensitivity* | 118 | 166 | 78 | 100 |

Table 12-continued

| Sample | E-8 | E-9 | E-10 | E-11 |
|---|---|---|---|---|
| Dmax | 1.48 | 1.58 | 1.31 | 1.40 |

*Relative sensitivity when the sensitivity of Sample E-11 was set as 100

Next, fresh Samples identical to Samples E-8 to E-11 were stored in a sealed container at a relative humidity of 80% at 35° C for 72 hours, the Samples were the subjected to sensitometry under the same conditions as above. The results obtained are shown in Table 13.

Table 13

| Sample | E:8 | E-9 | E-10** | E-11 |
|---|---|---|---|---|
| Thermal Fog | 0.11 | 0.30 | 0.34 | 0.18 |
| Sensitivity* | 85 | 94 | 52 | 65 |
| Dmax | 1.23 | 1.36 | 0.65 | 1.02 |

*Values when the sensitivity of Sample E-11 in the fresh state was set as 100
**Sample E-10 provided a red-brown image; others Samples provided a black image.

As is apparent from the results shown in Table 12 and Table 13, the combination of rosin and a sulfinate has an excellent effect on shaft life.

EXAMPLE 9

Mixture B prepared in the same manner in Example 3 was kept at 20° C, and the following components were successively added thereto in their recited order at 5 minute intervals to prepare Coating Composition (F-1).

1. dye of the following chemical formula
(0.025 wt % methanol solution) — 24 ml

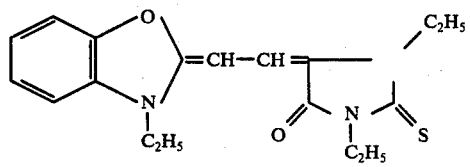

2. sodium 3-methylbenzenesulfinate (0.1 wt % methanol solution) — 100 ml
Staybelite (hydrogenated rosin produced by Arkawa Rinsan Co., acid value: about 160)
(3 wt % ethanol solution) — 50 ml
4. phthalazinone (color toning agent)
(3 wt % methanol solution) — 60 ml
5. p-phenylphenol (reducing agent)
(20 wt % acetone solution) — 50 ml For comparison, Coating Composition F-2was prepared in the same manner as that for the preparation of the Coating Composition F-1except for adding
3. stearic acid
(5wt % toluene solution) — 70 ml
s in place of Staybelite resin (3).

Moreover, for comparison, a Coating Composition F-3was prepared in the same manner as Coating Composition F-1except for omitting sodium 3-methylbenzenesulfinate (2).

In addition, for comparison, Coating Composition F-4 was prepared in the same manner as Coating Composition F-1 except for omitting Staybelite resin (3).

Each of the four Coating Compositions thus prepared was coated on an art paper at a silver coverage of 0.5 g/m² based on silver amount and then dried. Moreover, a 10 wt % acetone solution of cellulose diacetate containing 1.5 wt % of finely powdered silica having an average particle size of about 2 μ was coated thereon to provide an overcoat layer with a film thickness of 1.5 μ. The four thermally developable light-sensitive materials thus obtained were designated Samples F-1, F-2, F-3 and F-4, respectively.

These four Samples were subjected to sensitometry under the same conditions as in Example 6 except for carrying out development at a temperature of 120° C for 30 seconds. Relative sensitivity, Dmax and thermal fog were determined for each of the samples, and the results obtained are shown in Table 14.

Table 14

| Sample | F-1 | F-2 | F-3 | F-4 |
|---|---|---|---|---|
| Thermal Fog | 0.16 | 0.26 | 0.20 | 0.28 |
| Sensitivity* | 135 | 115 | 175 | 100 |
| Dmax | 1.03 | 1.06 | 1.11 | 0.85 |

Samples F-1 and F-3 provided green-black images; Samples F-2 and F-4 provided red-brown images
*Sensitivity based on that of Sample F-4 as 100

Next, fresh Samples identical to Samples F-1 to F-4 were placed in sealed container and kept at a relative humidity of 80% and 35° C for 48 hours; the Samples were then subjected to sensitometry under the same conditions as above. The results obtained are shown in Table 15.

Table 15

| Sample | F-1 | F-2 | F-3 | F-4 |
|---|---|---|---|---|
| Thermal Fog | 0.19 | 0.30 | 0.35 | 0.36 |
| Sensitivity* | 116 | 98 | 143 | 85 |
| Dmax | 0.85 | 0.86 | 0.93 | 0.63 |

*Values when the sensitivity of Sample F-4 in the fresh state was set as 100

It is apparent from the results shown in Table 14 and Table 15 that the combination of the rosin and a sulfinate had an excellent effect on shelf life and thermal fog.

EXAMPLE 10

To Mixture D prepared in the same manner as in Example 5, the following components were successively added in their recited order at 5 minute intervals at 25° C to prepare Coating Composition G-1.

1. sensitizing dye of the following chemical formula
(0.025 wt % 2-methoxy ethanol solution) — 1 ml

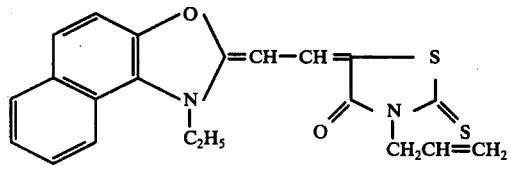

2. behenic acid
(5 wt % toluene solution) — 15 ml
3. rosin (TESTN 906 A 3111 produced by Kanto Chemical Co., Ltd; acid value about 165)
(2 wt % ethanol solution) — 4 ml
4. potassium p-toluenesulfinate
(0.1 wt % methanol solution) — 2 ml
5. 2,2'-methylenebis(6-t-butyl-4-methylphenol) (reducing agent)
(25 wt % acetone solution) — 3 ml
6. phthalazinone (color toning agent)
(3 wt % methanol solution) — 5 ml For comparison, Coating Composition G-2 was prepared in the same manner as Coating Composition G-1 except for omitting rosin (3). Moreover, for comparison, Coating Composition G-3 was prepared in the same manner as Coating Composition G-1 except for omitting potassium p-toluenesulfite (4). In addition, for comparison, Coating Composition G-4 was prepared in the same manner as Coating Composition G-1 except for omitting rosin (3) and potassium p-toluenesulfite (4).

Each of these four Coating Compositions thus prepared was coated on a polyethylene terephthalate film in an amount of 1.7 g/m² based on silver amount and dried to prepare four thermally developable light-sensitive materials, which were denoted as Samples G-1 to G-4, respectively.

The Samples were subjected to sensitometry under the same conditions as in Example 6 except for subjecting them to an exposure of 300,000 CMS and developing at 120° C for 13 seconds. In addition, density was measured as transmission density. The results obtained are shown in Table 16.

Table 16

| Sample | G-1 | G-2 | G-3 | G-4 |
|---|---|---|---|---|
| Thermal Fog | 0.10 | 0.45 | 0.15 | 0.78 |
| Sensitivity* | 155 | 73 | 170 | 100 |
| Dmax | 2.43 | 1.93 | 2.35 | 2.42 |

*Value based on the sensitivity of fresh photosensitive material G-4 (just after production) as 100

Next, fresh Samples identical to Samples G-1 to G-4 were placed in a sealed contained and kept at a relative humidity of 55% and at 35° C for 48 hours. The Samples were then subjected to sensitometry under the same conditions as above. The results obtained are shown in Table 17.

Table 17

| Sample | G-1 | G-2 | G-3 | G-4 |
|---|---|---|---|---|
| Thermal Fog | 0.18 | 0.60 | 0.35 | 1.39 |
| Sensitivity* | 135 | 55 | 132 | 100 |
| Dmax | 2.13 | 1.53 | 2.14 | 2.12 |

*Value based on the sensitivity of fresh photosensitive material G-4 (just after production) as 100

It is apparent from the results shown in Table 16 and Table 17 that the combination of rosin and a sulfinate provides remarkably excellent effects.

While the invention has been described in detail and with reference to specific embodiments thereof, it will be apparent to one skilled in the art that various changes and modifications can be made therein without departing from the spirit and scope thereof.

What is claimed is:

1. In a thermally developable light-sensitive material comprising a support having thereon at least one layer containing at least (a) an organic silver salt, (b) a light-sensitive silver halide or a component capable of forming a light-sensitive silver halide and (c) a reducing agent, the improvement wherein at least one layer provided on the support comprises (d) at least one member selected from the group consisting of rosin of an acid value of more than about 100, one or more diterpene acids selected from the group consisting of abietic acid, pimaric acid, neoabietic acid, levopimaric acid, iso-d-pimaric acid, podocarpic acid, agathenedicarboxylic acid, rubenic acid, dihydroabeitic acid, tetrahydroabietic acid and dehydroabietic acid or a mixture thereof, in an amount sufficient to decrease heat fogging and to improve the storability of the light-sensitive material which is in the range of about 0.001 mol to about 10 mol per mol of said organic silver salt (a).

2. The thermally developable light-sensitive material of claim 1, wherein said at least one layer provided on the support contains at least one member selected from the group consisting of one or more sulfinic acids, one or more salts thereof or a mixture thereof.

3. The thermally developable light-sensitive mterial of claim 1, wherein said member is rosin of an acid value of about 130 to about 200.

4. The thermally developable light-sensitive material of claim 1, wherein said member is one or more diterpene acids.

5. The thermally developable light-sensitive material of claim 1, wherein said member is a mixture of rosin and one or more diterpene acids.

6. The thermally developable light-sensitive material of claim 1, wherein said member is present in said at least one layer which contains at least (a) an organic silver salt, (b) a light-sensitive silver halide or a component capable of forming a light-sensitive silver halide and (c) a reducing agent.

7. The thermally developable light-sensitive material of claim 1, wherein component (b) is present in a layer containing said organic silver salt (a).

8. The thermally developable light-sensitive material of claim 1, wherein the amount of component (d) is from about 0.01 to about 2 mols per mol of organic silver salt (a).

9. The thermally developable light-sensitive material of claim 2, wherein said sulfinic acids are represented by the general formula:

s $R - SO_2M$ s wherein R represents a monovalent aliphatic or aromatic group and M is a positive monovalent ion.

10. The thermally developable light-sensitive material of claim 9, wherein R is an alkyl group of 6–22 carbon atoms.

11. The thermally developable light-sensitive material of claim 9, wherein R is an alkyl group having 2–22 carbon atoms and is selected from the class consisting of a haloalkyl group, a nitroalkyl group, an alkoxyalkyl group having 1 – 8 carbon atoms in the alkoxy group, a hydroxyalkyl group, a cyanoalkyl group, a carboxyalkyl group, an aminoalkyl group and an acetylamino group.

12. The thermally developable light-sensitive material of claim 9, wherein said aromatic group is selected from the class consisting of a phenyl group and a naphthyl group.

13. The thermally developable light-sensitive material of claim 9, wherein said aromatic group is selected from the class consisting of a phenyl group and a naphthyl group which are substituted with an alkyl group having 1 to 8 carbon atoms, a halogen atom, a haloalkyl group wherein the alkyl moiety has 1 to 8 carbon atoms, a nitro group, a phenyl group, a naphthyl group, an alkylphenyl group wherein the alkyl moiety has 1 to 4 carbon atoms, a hydroxy group, a cyano group, a carboxyl group, an amino group or an acetamido group.

14. The thermally developable light-sensitive material of claim 2, wherein the sulfinic acid or salt thereof is selected from the class consisting of n-octylsulfinic acid, sodium n-octylsulfiniate, disodium 2-carboxyethylsulfinate, sodium 2-cyanoethylsulfinate, sodium 2-ethoxycarbonylethylsulfinate, benzenesulfinic acid dihydrate, p-toluenesulfinic acid, sodium benzenesulfinate, sodium p-toluenesulfinate, potassium benzenesulfinate, zinc p-toluenesulfinate, ammonium p-toluenesulfinate, 4-tert-butylbenzenesulfinic acid, p-bromobenzenesulfinic acid, p-chlorobenzenesulfinic acid, 4-acetamidobenzenesulfinic acid, sodium 3,4-dimethylbenzenesulfinate, potassium 3-methylbenzenesulfinate, 4-nitrobenzenesulfinic acid, potassium 2-naphthylsulfinate or mixtures thereof.

15. The thermally developable light-sensitive material of claim 2, wherein said sulfinic acid or salt thereof is present in an amount of from about 0.0001 mol to about 1 mol per mol or organic silver salt (a).

* * * * *